US010648149B1

(12) United States Patent
Santha

(10) Patent No.: US 10,648,149 B1
(45) Date of Patent: May 12, 2020

(54) FIBER BLOCK SYSTEM

(71) Applicant: B. Lanka Santha, McDonough, GA (US)

(72) Inventor: B. Lanka Santha, McDonough, GA (US)

( * ) Notice: Subject to any disclaimer, the term of this patent is extended or adjusted under 35 U.S.C. 154(b) by 0 days.

(21) Appl. No.: 16/583,440

(22) Filed: Sep. 26, 2019

(51) Int. Cl.
*E02B 3/10* (2006.01)
*E02D 17/20* (2006.01)
*E02D 29/02* (2006.01)

(52) U.S. Cl.
CPC ..... *E02D 17/202* (2013.01); *E02B 3/106* (2013.01); *E02D 29/0266* (2013.01); *E02D 2300/0051* (2013.01)

(58) Field of Classification Search
CPC . E02B 3/10; E02B 3/106; E02B 3/125; E02D 17/202; E02D 17/205
USPC ..... 405/107, 114, 115
See application file for complete search history.

(56) References Cited

U.S. PATENT DOCUMENTS 3,973,355 A 8/1976 McKenzie
4,031,676 A * 6/1977 Dally ..... D06F 39/081 52/102
4,434,576 A 3/1984 Sowerwine
4,926,587 A 5/1990 van Wingerden
4,960,349 A 10/1990 Willibey et al.
5,059,065 A * 10/1991 Doolaege ..... E02B 3/127 405/107
5,091,247 A 2/1992 Willibey et al.
5,161,917 A 10/1992 Papetti
5,236,281 A * 8/1993 Middleton ..... B65D 90/24 404/14
5,309,673 A 5/1994 Stover et al.
5,338,131 A 8/1994 Bestmann
5,421,123 A 6/1995 Sakate et al.
5,425,597 A 6/1995 Bestmann
5,595,458 A 1/1997 Grabhorn
5,605,416 A 2/1997 Roach
5,641,244 A 6/1997 Bestmann
5,651,641 A 7/1997 Stephens et al.
5,658,096 A 8/1997 Von Kanel
5,678,954 A 10/1997 Bestmann
5,735,640 A 4/1998 Meyer et al.
5,951,202 A 9/1999 Brown
5,997,213 A 12/1999 Dennis et al.
6,109,835 A 8/2000 Grabhorn
6,127,027 A 10/2000 Nogami et al.
6,168,349 B1 1/2001 Perslow et al.
6,234,721 B1 5/2001 Cronkhite et al.
6,267,533 B1 7/2001 Bourg
6,547,493 B2 4/2003 Spangler et al.
6,616,383 B2 9/2003 Janz
6,709,202 B2 3/2004 Spangler et al.
(Continued)

FOREIGN PATENT DOCUMENTS

CA 2882653 A1 * 8/2015 ..... E02B 3/125
EP 0480890 A1 4/1992
(Continued)

*Primary Examiner* — Frederick L Lagman
(74) *Attorney, Agent, or Firm* — Thomas B. McGurk

(57) ABSTRACT

A fiber block system suitable for check dam applications is described that comprises a central section flanked by two shorter wing sections. Each section comprises a fiber block enclosed in a sleeve of mesh. The fiber block, mesh, and ties can be made of coir fibers.

19 Claims, 18 Drawing Sheets

(56) References Cited

U.S. PATENT DOCUMENTS

| | | | | |
|---|---|---|---|---|
| 6,893,193 | B2 | 5/2005 | Santha | |
| 6,910,835 | B2 * | 6/2005 | Spangler | E02B 3/04 405/302.6 |
| 7,029,208 | B1 | 4/2006 | Santha | |
| 8,740,503 | B1 | 6/2014 | Tyler | |
| 9,057,168 | B1 * | 6/2015 | Dugan, Jr. | E02B 7/20 |
| 9,315,962 | B2 | 4/2016 | Santha | |
| 9,387,983 | B2 * | 7/2016 | Happy | B65D 90/24 |
| 10,280,578 | B2 | 5/2019 | Santha | |
| 2002/0073616 | A1 | 6/2002 | Pelton | |
| 2003/0017000 | A1 | 1/2003 | Jansson | |
| 2003/0143026 | A1 | 7/2003 | Santha | |
| 2004/0005198 | A1 | 1/2004 | Spangler | |
| 2014/0050527 | A1 * | 2/2014 | Kelsey | E02B 3/12 405/17 |
| 2015/0240438 | A1 | 8/2015 | Santha | |
| 2017/0204582 | A1 * | 7/2017 | Allard | E02B 3/125 |
| 2019/0055706 | A1 * | 2/2019 | Santha | E02D 29/0266 |

FOREIGN PATENT DOCUMENTS

| | | | |
|---|---|---|---|
| JP | 359126824 | A | 7/1984 |
| JP | 403055316 | A | 3/1991 |
| JP | 403233021 | A | 10/1991 |
| JP | 406212609 | A | 8/1994 |

* cited by examiner

FIBER BLOCK SYSTEM

TECHNICAL FIELD

The present disclosure is directed generally to fiber block systems, and, more specifically, to fiber block systems for check dam applications.

BACKGROUND

In the construction industry, various types of check dams are used in ditches to reduce the velocity of water flow so as to reduce or to eliminate erosion in the ditch bed and to collect sediment carried by the water flow. Settling of sediment carried by the water flow is intended to occur when the water flow encounters the check dam and flows over it. When conventional check dams with standard lengths are used in such applications, issues can arise from water flow bypassing the conventional dams and flowing around the sides thereof. When this bypassing occurs, sediment carried by the water flow does not have on opportunity to settle.

Conventional forms of wattles and logs used in check dam applications are generally circular in cross section. The circular structure results from the method of construction in which a tube of netting is stuffed with filler from one end. When installed, less than the entire diameter of the circular log will contact the ground due to its shape, resulting in performance issues that require additional installation steps to address. Water tends to flow between the ground and convention cylindrical wattles and logs since they lack sufficient contact and downward pressure to form adequate barriers to water flow. The additional installation steps that are sometimes taken with conventional wattles and logs can include the digging of trenches and the extensive use of ropes to anchor the circular wattles and logs in place. Use of anchoring ropes tends to result in water flowing between the circular log and the rope, thereby undercutting the log and at least partially defeating the purpose thereof. Furthermore, the performance efficiency per unit of weight of a conventional wattle log is not optimal due to the log being wider in diameter than the diameter of the portion thereof that actually contacts the ground.

Consequently, there is a need for a system usable in check dam applications that can address one or more of these and other shortcomings.

SUMMARY

The present disclosure encompasses a fiber block system check dam applications comprising, consisting of, or consisting essentially of: a central section comprising a central fiber block and a central sleeve encasing the central fiber block, wherein the central fiber block comprises a central top side, a central bottom side opposing the central top side, a central front side connected to the central top side, a central rear side opposing the central front side and extending between the central top side and the central bottom side, a central right side, and a central left side opposing the central right side, wherein the central fiber block exhibits a central fiber block height measured from the central bottom side to the central top side, wherein the central sleeve comprises natural fibers, and wherein the central fiber block comprises compressed natural fibers;

a first wing section connected to the central section, wherein the first wing section comprises a first wing fiber block and a first wing sleeve encasing the first wing fiber block, wherein the first wing fiber block comprises a first wing top side, a first wing bottom side opposing the first wing top side, a first wing front side connected to the first wing top side, a first wing rear side opposing the first wing front side and extending between the first wing top side and the first wing bottom side, a first wing right side, and a first wing left side opposing the first wing right side, wherein the first wing right side abuts the central left side of the central fiber block, wherein the first wing fiber block exhibits a first wing fiber block height measured from the first wing top side to the first wing bottom side, wherein the central fiber block height is greater than the first wing fiber block height, wherein the first wing sleeve comprises, consists essentially of, and/or consists of natural fibers, and wherein the first wing fiber block comprises, consists essentially of, and/or consists of compressed natural fibers; and, a second wing section connected to the central section, wherein the second wing section comprises a second wing fiber block and a second wing sleeve encasing the second wing fiber block, wherein the second wing fiber block comprises a second wing top side, a second wing bottom side opposing the second wing top side, a second wing front side connected to the second wing top side, a second wing rear side opposing the second wing front side and extending between the second wing top side and the second wing bottom side, a second wing right side, and a second wing left side opposing the second wing right side, wherein the second wing left side abuts the central right side of the central fiber block, wherein the second wing section exhibits a second wing fiber block height measured from the second wing top side to the second wing bottom side, wherein the central fiber block height is greater than the second wing fiber block height, wherein the second wing sleeve comprises, consists essentially of, and/or consists of natural fibers, and wherein the second wing fiber block comprises, consists essentially of, and/or consists of compressed natural fibers.

In another aspect, the fiber block system further comprises a plurality of central ties extending through the central fiber block, wherein each central tie of the plurality of central ties comprises a central first end extending through one of the central top side, the central bottom side, the central front side, and the central rear side of the central fiber block and a central second end extending through another of the central top side, the central bottom side, the central front side, and the central rear side of the central fiber block, wherein each central tie of the plurality of central ties connects to the central sleeve at the central first end and the central second end of the central tie, whereby the plurality of central ties supports the central fiber block, and wherein each central tie of the plurality of central ties comprises, consists essentially of, and/or consists of natural fibers.

In another aspect, the fiber block system further comprises a plurality of first wing ties extending through the first wing fiber block, wherein each first wing tie of the plurality of first wing ties comprises a first wing end extending through one of the first wing top side, the first wing bottom side, the first wing front side, and the first wing rear side of the first wing fiber block and a second wing end extending through another of the first wing top side, the first wing bottom side, the first wing front side, and the first wing rear side of the first wing fiber block, wherein each first wing tie of the plurality of first wing ties connects to the first wing sleeve at the first wing end and at the second wing end of the first wing tie, whereby the plurality of first wing ties supports the first wing fiber block, and wherein each first wing tie of the plurality of first wing ties comprises, consists essentially of, and/or consists of natural fibers.

In yet another aspect, the fiber block system further comprises a plurality of second wing ties extending through the second wing fiber block, wherein each second wing tie of the plurality of second wing ties comprises a first wing end extending through one of the second wing top side, the second wing bottom side, the second wing front side, and the second wing rear side of the second wing fiber block and a second wing end extending through another of the second wing top side, the second wing bottom side, the second wing front side, and the second wing rear side of the second wing fiber block, wherein each second wing tie of the plurality of second wing ties connects to the second wing sleeve at the first wing end and the second wing end of the second wing tie, whereby the plurality of second wing ties supports the second wing fiber block, and wherein each second wing tie of the plurality of second wing ties comprises, consists essentially of, and/or consists of natural fibers.

In a further aspect, the central fiber block can exhibit a central fiber block width measured from the central front side to the central rear side, and wherein the central fiber block height is greater than the central fiber block width. In still another aspect, the ratio of the central fiber block height to the central fiber block width can be about 3:1 or greater than about 3:1. In another aspect, the first wing fiber block can exhibit a first wing fiber block width measured from the first wing front side to the first wing rear side, and wherein the first wing fiber block height is greater than the first wing fiber block width. In still a further aspect, the ratio of the first wing fiber block height to the first wing fiber block width can be about 1.5:1 or greater than about 1.5:1. In yet another aspect, the second wing fiber block can exhibit a second wing fiber block width measured from the second wing front side to the second wing rear side, and wherein the second wing fiber block height is greater than the second wing fiber block width. In another aspect, the fiber block system can be reconfigurable between a folded configuration and an extended configuration, wherein the first wing section is folded with the first wing left side aligned proximal to the central left side of the central fiber block and the second wing section is folded with the second wing right side aligned proximal to the central right side in the folded configuration, and wherein the first wing section is unfolded and extended with the first wing left side aligned distal to the central left side of the central fiber block and the second wing section is unfolded and extended with the second wing right side aligned distal to the central right side in the extended configuration. In a further aspect, the first wing left side can be connected to the central left side and the second wing right side is connected to the central right side in the folded configuration. In a further aspect, the natural fibers can comprises, consists essentially of, and/or consists of coir fibers.

In yet another aspect, the present disclosure encompasses a fiber block system chain comprising a plurality of fiber block systems, wherein each fiber block system of the plurality of fiber block systems is connected to another fiber block system of the plurality of fiber block systems. In a further aspect, each fiber block system of the plurality of fiber block systems can be in a folded configuration, wherein the first wing section of each fiber block system of the fiber block system chain is folded with the first wing left side aligned proximal to the central left side of the central fiber block of the fiber block system and the second wing section of each fiber block system of the fiber block system chain is folded with the second wing right side aligned proximal to the central right side of the central fiber block of the fiber block system.

The present disclosure also encompasses a fiber block system for check dam applications comprises, consists essentially of, and/or consists of: a central section comprising a central fiber block and a central sleeve encasing the central fiber block, wherein the central fiber block is rectangular, wherein the central fiber block comprises a central fiber block length, a central fiber block height, and a central fiber block width, wherein the central fiber block length is greater than the central fiber block width, wherein the central fiber block height is greater than the central block width, wherein the central sleeve comprises, consists essentially of, and/or consists of natural fibers, and wherein the central fiber block comprises, consists essentially of, and/or consists of natural fibers;

a first wing section connected to the central section, wherein the first wing section comprises a first wing fiber block and a first wing sleeve encasing the first wing fiber block, wherein the first wing fiber block is rectangular, wherein the first wing fiber block comprises a first wing fiber block length, a first wing fiber block height, and a first wing fiber block width, wherein the first wing fiber block length is greater than the first wing block width, wherein the first wing fiber block height is greater than the first wing fiber block width, wherein the central fiber block height is greater than the first wing fiber block height, wherein the first wing section abuts the central section, wherein the first wing section is aligned endways with the central section, wherein the first wing sleeve comprises, consists essentially of, and/or consists of natural fibers, and wherein the first wing fiber block comprises, consists essentially of, and/or consists of compressed natural fibers, and, a second wing section connected to the central section, wherein the section wing section comprises a second wing fiber block and a second wing sleeve encasing the second wing fiber block, wherein the second wing fiber block is rectangular, wherein the second wing fiber block comprises a second wing fiber block length, a second wing fiber block height, and a second wing fiber block width, wherein the second wing fiber block length is greater than the second wing fiber block width, wherein the second wing fiber block height is greater than the second wing fiber block width, wherein the central fiber block height is greater than the second wing fiber block height, wherein the second wing section abuts the central section, wherein the second wing section is aligned endways with the central section, wherein the second wing sleeve comprises, consists essentially of, and/or consists of natural fibers, and wherein the second wing fiber block comprises, consists essentially of, and/or consists of compressed natural fibers.

In another aspect, the fiber block system can be reconfigurable between a folded configuration and an extended configuration, wherein the first wing section and the second wing section are folded inward towards the central section in the folded configuration, and wherein the first wing section and the second wing section are unfolded and extended in the extended configuration. In a further aspect, the ratio of the central fiber block height to the central fiber block width is about 3:1 or greater than about 3:1, and wherein the first wing fiber block height is about equal to the second wing fiber block height.

The present disclosure also encompasses a fiber block system for check dam applications comprises, consists essentially of, and/or consists of: a central section comprising a central fiber block and a central sleeve encasing the central fiber block, wherein the central fiber block comprises a central top side, a central bottom side opposing the central top side, a central front side connected to the central top side, a central rear side opposing the central front side and extending between the central top side and the central bottom side, a central right side, and a central left side opposing the central right side, wherein the central fiber block exhibits a central fiber block height measured from the central bottom side to the central top side, wherein the central fiber block exhibits a central fiber block width measured from the central front side to the central rear side, wherein the ratio of the fiber block height to the central fiber block width is about 3:1 or greater than about 3:1, wherein the central sleeve comprises, consists essentially of, and/or consists of natural fibers, and wherein the central fiber block comprises, consists essentially of, and/or consists of compressed natural fibers; a first wing section connected to the central section, wherein the first wing section comprises a first wing fiber block and a first wing sleeve encasing the first wing fiber block, wherein the first wing fiber block comprises a first wing top side, a first wing bottom side opposing the first wing top side, a first wing front side connected to the first wing top side, a first wing rear side opposing the first wing front side and extending between the first wing top side and the first wing bottom side, a first wing right side, and a first wing left side opposing the first wing right side, wherein the first wing right side abuts the central left side of the central fiber block, wherein the first wing fiber block exhibits a first wing fiber block height as measured from the first wing top side to the first wing bottom side, wherein the ratio of the central fiber block height to the first wing fiber block height is about 2:1 or greater than about 2:1, wherein the first wing sleeve comprises, consists essentially of, and/or consists of natural fibers, and wherein the first wing fiber block comprises, consists essentially of, and/or consists of compressed natural fibers; and, a second wing section connected to the central section, wherein the second wing section comprises a second wing fiber block and a second wing sleeve encasing the second wing fiber block, wherein the second wing fiber block comprises a second wing top side, a second wing bottom side opposing the second wing top side, a second wing front side connected to the second wing top side, a second wing rear side opposing the second wing front side and extending between the second wing top side and the second wing bottom side, a second wing right side, and a second wing left side opposing the second wing right side, wherein the second wing left side abuts the central right side of the central fiber block, wherein the second wing section exhibits a second wing fiber block height measured from the second wing top side to the second wing bottom side, wherein the ratio of the central fiber block height to the second wing fiber block height is about 2:1 or greater than about 2:1, wherein the second wing sleeve comprises, consists essentially of, and/or consists of natural fibers, wherein the second wing fiber block comprises, consists essentially of, and/or consists of natural fibers.

These and other aspects of the present disclosure are set forth in greater detail below and in the drawings for which a brief description is provided as follows.

DETAILED DESCRIPTION

The present disclosure encompasses fiber block systems that can be used in check dam applications. The present disclosure refers in detail below to various aspects of fiber block systems and fiber block system chains, which are illustrated in the accompanying drawings. Wherever possible, the application uses the same reference numbers throughout the drawings to refer to the same or similar items.

As used herein, the singular forms of "a," "an," and "the" encompass the plural forms thereof unless otherwise indicated. As used herein, the phrase "at least one" includes all numbers of one and greater. As used herein, the term "and/or" refers to one or all of the listed elements or a combination of any two or more of the listed elements. As used herein, the phrase "integrally formed" means formed as a single, unitary body.

The fiber block systems encompassed by the present disclosure can comprise natural materials that are ecologically friendly and that can aid in check dam applications. Because the fiber block systems encompassed by the present disclosure can comprise natural materials and can aid in controlling erosion, the systems can be installed in environmentally sensitive areas. Among the natural materials that can be used in the fiber blocks, sleeves, meshes, and ties of the fiber block systems is coconut or coir fiber, which can be used to form any one or more of these components and provide the desired characteristics of the systems.

Figure 1:
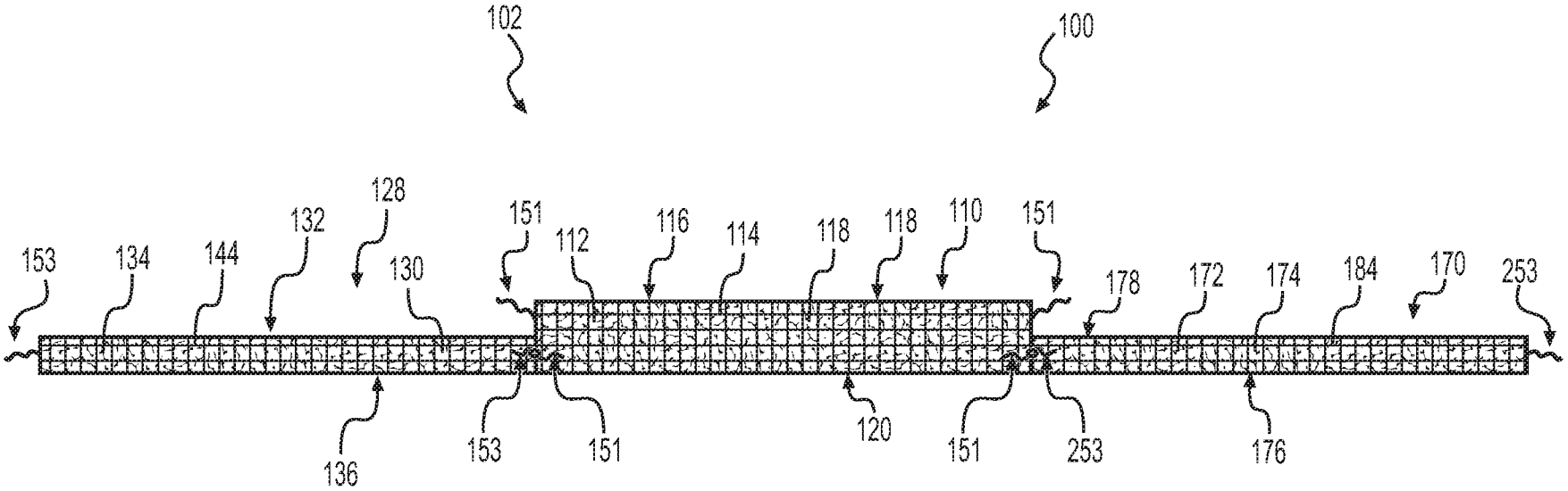
FIG. 1 is a front elevation view of a fiber block system encompassing aspects of the present disclosure, wherein the fiber block system is arranged in an extended configuration.
Figure 2:
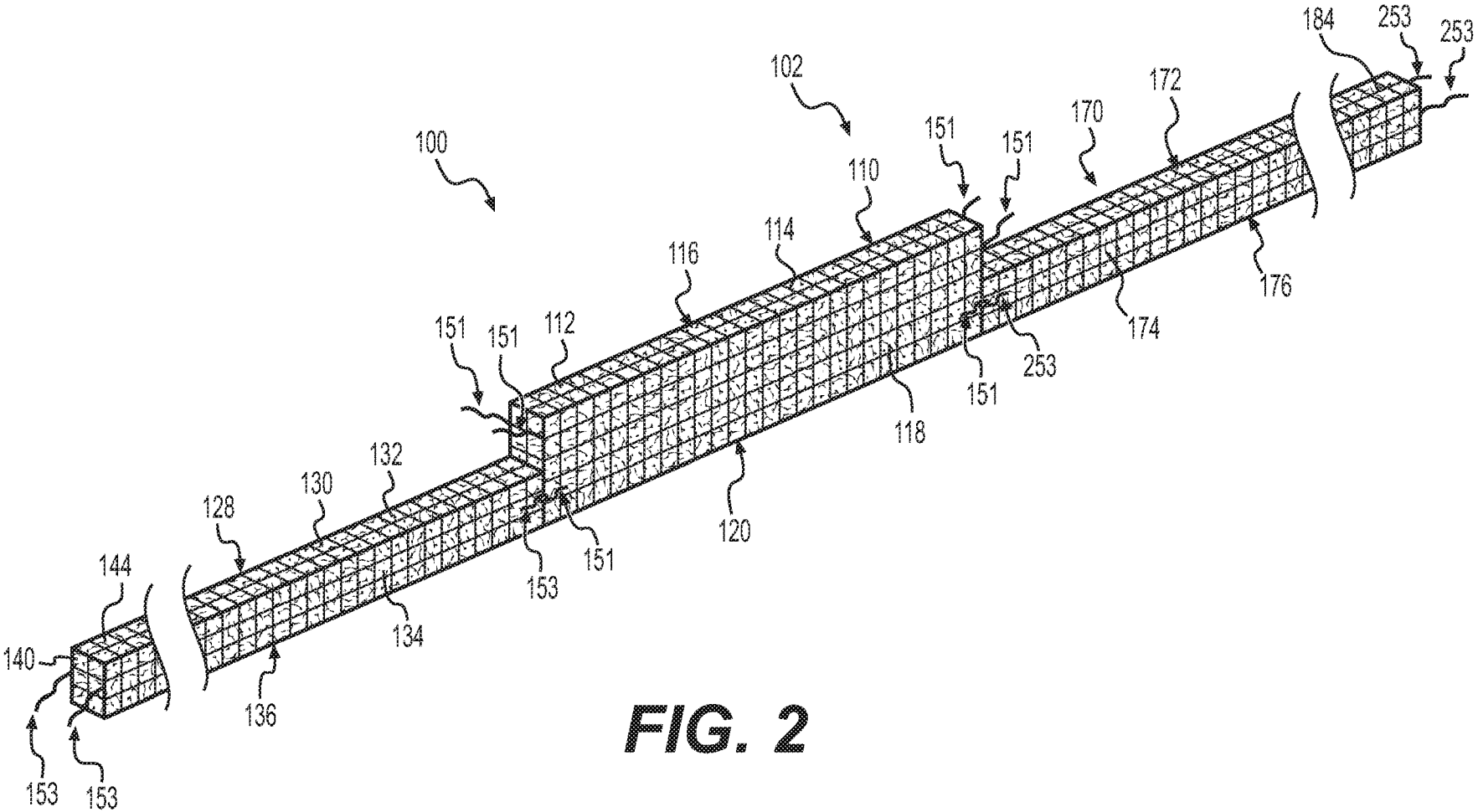
FIG. 2 is a perspective view of the fiber block system shown in FIG. 1.
Figure 3:
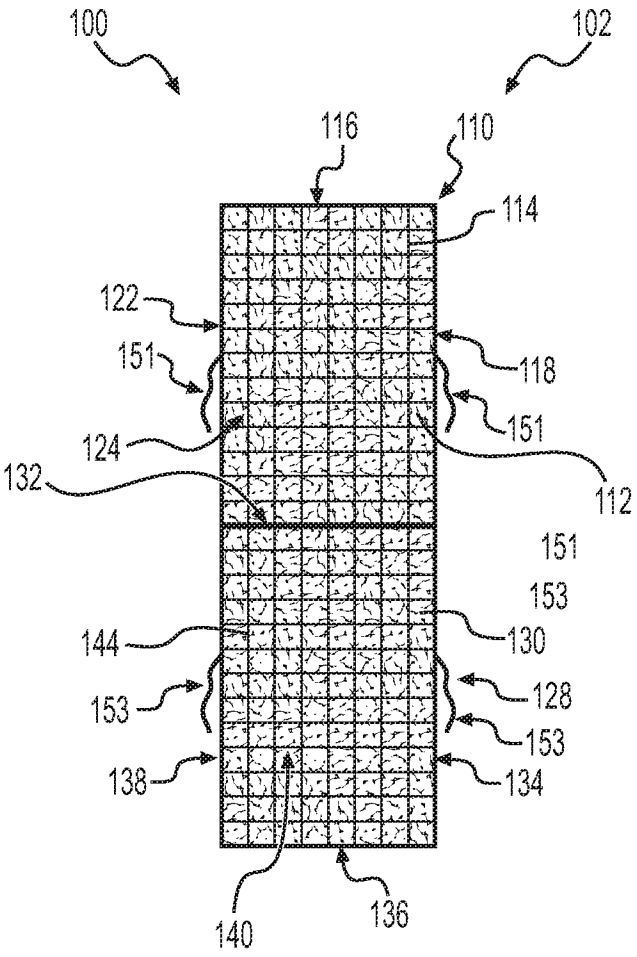
FIG. 3 is left side elevation view of the fiber block system shown in FIG. 1.

FIGS. 1-18 illustrate a fiber block system 100, parts thereof, and chains of such fiber block systems 100, all encompassing aspects of the present disclosure. As shown in FIGS. 1 and 2, the fiber block system 100 comprises three sections: a central section 110, a first wing section 128 connected to a first end of the central section 110, and a second wing section 170 connected to a second end of the central section 110. The first wing section 128 and the second wing section 170 are aligned endways on opposing sides of the central section 110 and extend outward therefrom. The first wing section 128 and the second wing section 170 are connected to and abut the respective sides of the central section 110. As shown in FIG. 3, the central section 110 is taller than the first wing section 128 and is about equal in width to the first wing section 128 and the second wing section 170. As shown in FIGS. 1-3, the central section 110, the first wing section 128, and the second wing section 170 are aligned endways and lengthwise with the central section 110 flanked by the first wing section 128 on one end and the second wing section on the opposing end.

Figure 4:
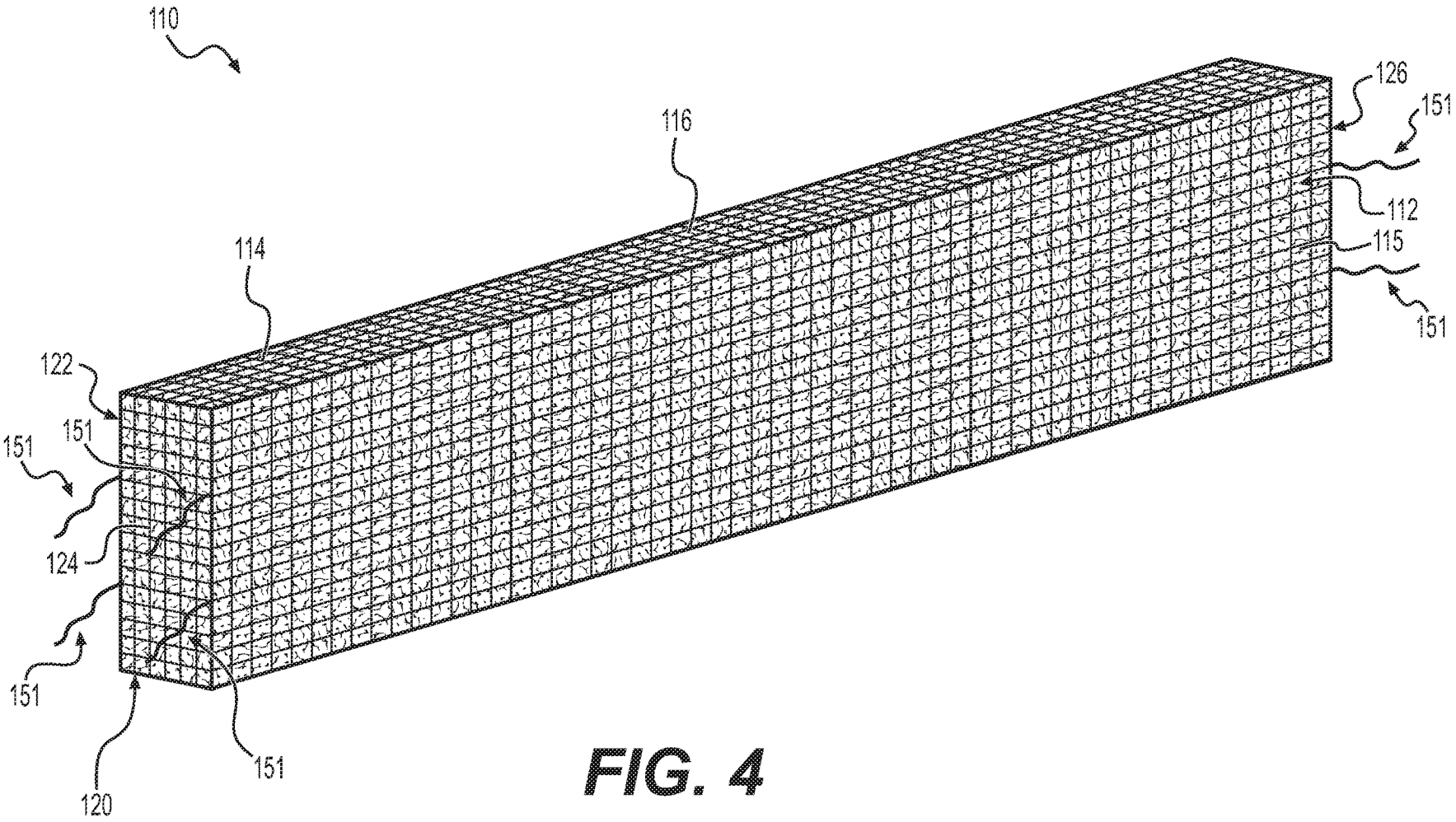
FIG. 4 is a perspective view of the central section of the fiber block system shown in FIG. 1 with the two wing sections removed.

As shown in FIG. 4, the central section 110 comprises a central fiber block 112 formed of compressed coir fibers 115 encased in a central sleeve 114 of a high strength central mesh 146. The central mesh 146 can comprise natural fibers, such as coir fibers, other biodegradable fibers, or of twine made with biodegradable fibers wrapped around a synthetic core. In one aspect, both the central fiber block 112 and the central sleeve 114 consist essentially of coir fibers.

Figure 5:
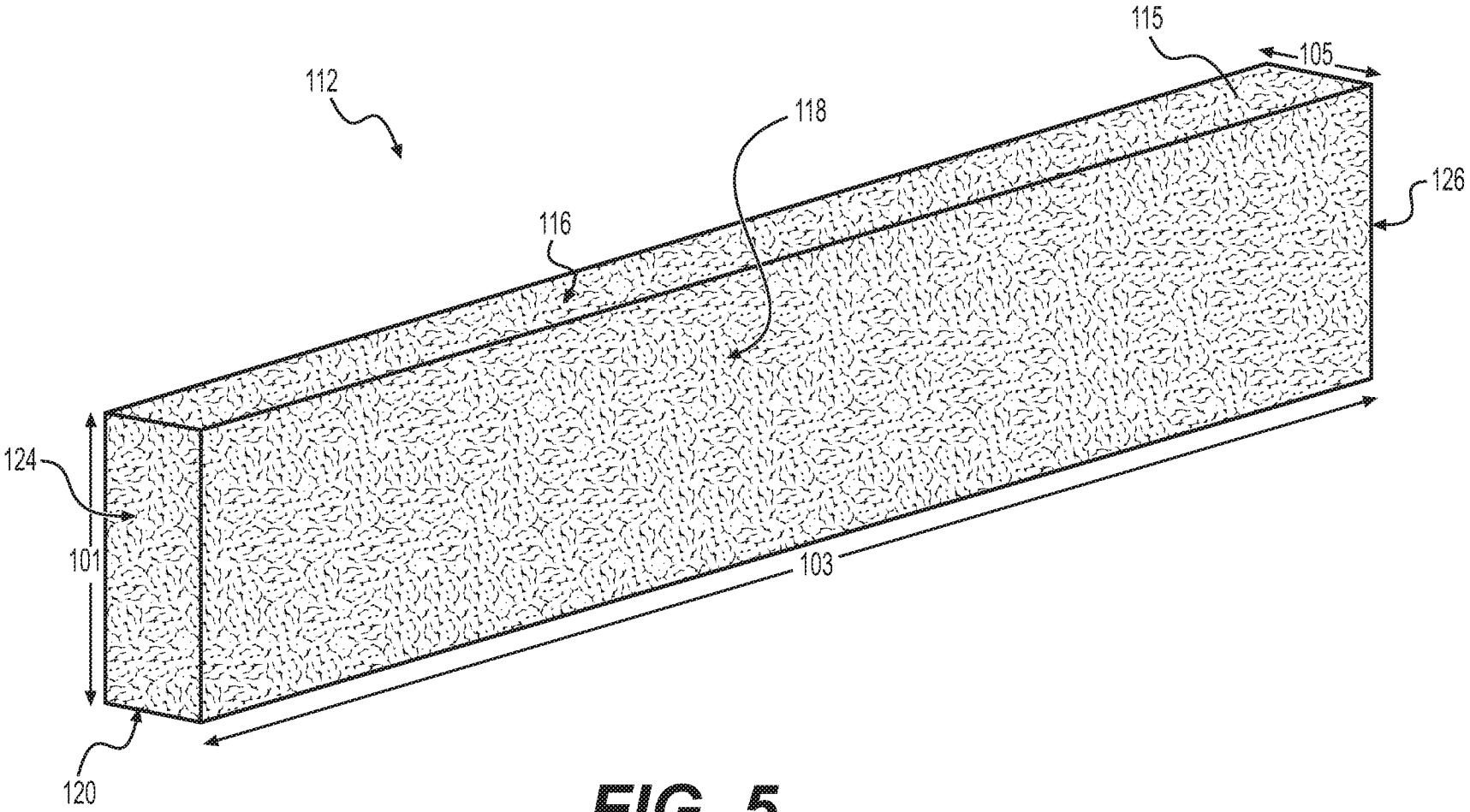
FIG. 5 is a perspective view of the central fiber block of the central section of the fiber block system shown in FIG. 4 with the central sleeve removed.

The central fiber block 112, shown in FIG. 5, comprises an elongated portion that is rectangular in cross-section. The central fiber block 112 comprises a central top side 116, a central bottom side 120 opposing the central top side 116, a central front side 118, a central rear side 122 opposing the central front side 118, a central left side 124, and a central right side 126 opposing the central left side 130. Each of the central top side 116, the central front side 118, the central bottom side 120, the central rear side 122, the central left side 124 and the central right side 126 are generally flat and rectangular. The central fiber block 112 is completely encased in the central sleeve 114. The central mesh 146 of the central sleeve 114 covers the central top side 116, the central front side 118, the central rear side 122, the central bottom side 120, the central left side 124, and the central right side 126 of the central fiber block 112. A plurality of connecting ties 151 are attached to or near the ends of the central mesh 146 and extend therefrom. The connecting ties 151 are arranged to connect to the first wing section 128 and the second wing section 170 so as to secure the first wing section 128 and the second wing section 170 to the central section 110.

The central fiber block 112 comprises a central fiber block height 101 measured from the central top side 116 to the central bottom side 120, a central fiber block length 103 measured from the central left side 124 to the central right side 126, and a central fiber block width 105 measured from central front side 118 to the central rear side 122. The central fiber block height 101 is greater than the central fiber block width 105. The central fiber block length 103 is greater than both central fiber block height 101 and the central fiber block width 105. In one aspect, the ratio of the central fiber block height 101 to the central fiber block width 105 can be about 3:1. In another aspect, the ratio of the central fiber block height 101 to the central fiber block width 105 can be greater than about 3:1.

Figure 6:
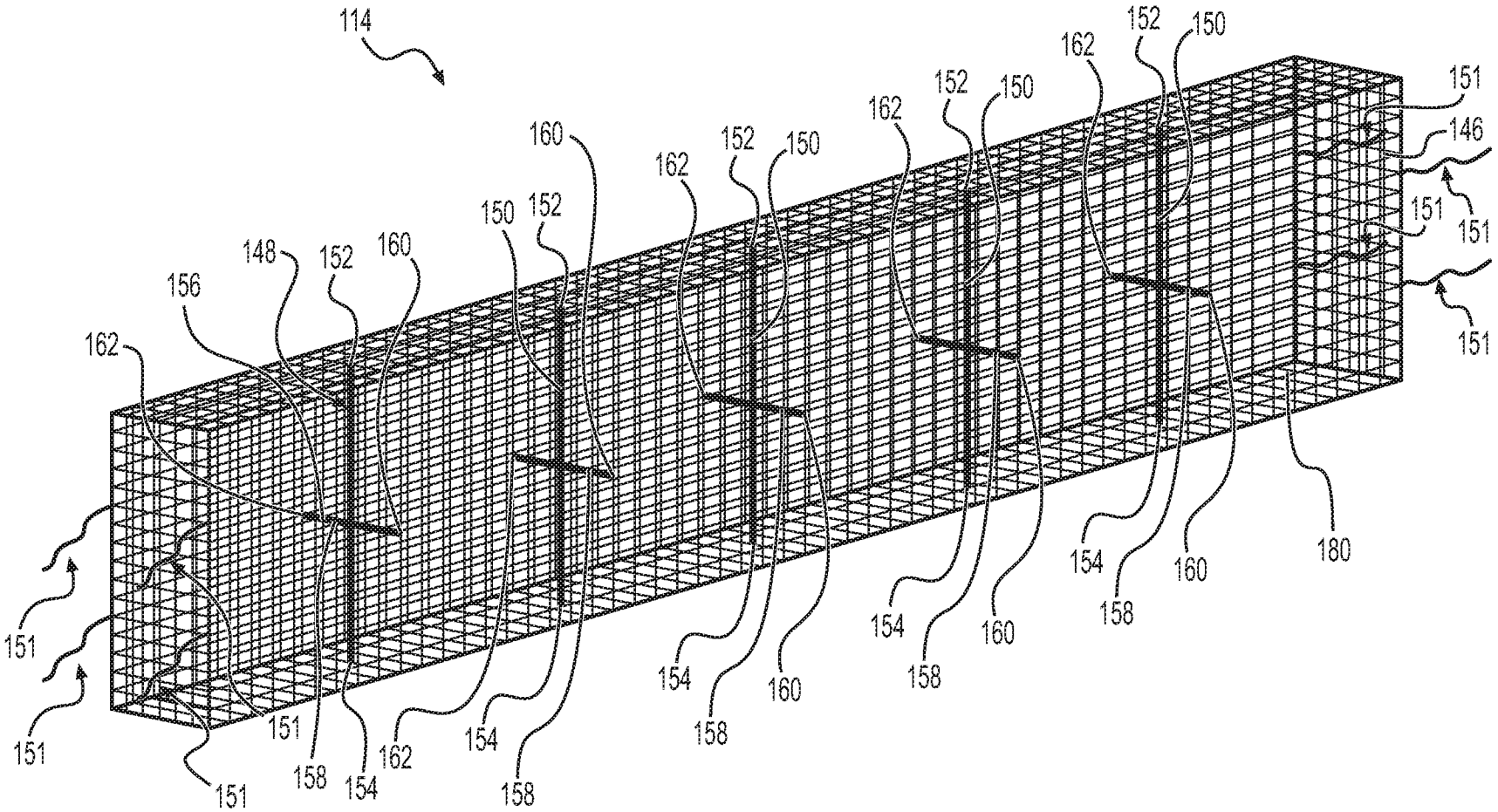
FIG. 6 is a perspective view of the central sleeve of the central section of the fiber block system shown in FIG. 4 with the central fiber block removed.

FIG. 6 illustrates a plurality of central ties 148 disposed in the central sleeve 114 and attach to the central mesh 146 at two different points. Each central tie of the plurality of centrals ties 148 extends through the central fiber block 112 and outward from two sides of the central fiber block 112 connecting to the central sleeve 114 at each end thereof.

Each central tie of the plurality of central ties 148 can be either a central standing tie 150 that extends outward from the central top side 116 and the central bottom side 120 of the central fiber block 112 or a central recumbent tie 158 that extends outward through the central front side 118 and the central rear side 122 the central fiber block 112. Each central standing tie 150 and each central recumbent tie 158 of the plurality of central ties 148 extends through two opposing sides of the central fiber block 112 and is attached to the central sleeve 114. Each central standing tie 150 comprises a central standing first end 152 that extends through the central top side 116 of the central fiber block 112 and is attached to the central sleeve 114 at the central top side 116 of the central fiber block 112 and a central second standing end 154 that extends through the central bottom side 120 of the central fiber block 112 and is attached to the central sleeve 114 at the central bottom side 120 of the central fiber block 112. Each central recumbent tie 158 comprises a central recumbent first end 160 that extends through the central front side 118 of the central fiber block 112 and is attached to the central sleeve 114 at the central front side 118 of the central fiber block 112 and a central recumbent second end 162 that extends through the central rear side 122 of the central fiber block 112 and is attached to the central sleeve 114 at the central rear side 122 of the central fiber block 112. The plurality of central ties 148 helps to maintain the rectangular shape and integrity of the central section 110 inhibiting the central sleeve 114 from bulging outward. The central sleeve 114, in turn, tends to keep inward pressure on the sides of the central fiber block 112 so as to aid it in maintaining its rectangular shape. A majority of the length of each central tie of the plurality of central ties 148 is encased in the compressed coir fibers of the central fiber block 112 with only the first and second ends of each central tie extending outward from the sides of the central fiber block 112. Each central standing tie 150 can contact and/or be intertwined with a central recumbent tie 158 to further aid in maintaining the strength and form of the central fiber block 112. Some of the central ties of the plurality of central ties 148 can be stitched or otherwise connected to the outer sides of the central fiber block 112 and also to the central sleeve 114 to reinforce the shape and integrity of the central section 110. In one aspect, the central standing ties 150 can be aligned generally vertically and the central recumbent ties 158 can be aligned generally horizontally in the central fiber block 112. In another aspect, the central standing ties 150 and/or the central recumbent ties 158 can be aligned oblique to one or more sides of the central fiber block 112. In still another aspect, the central standing ties 150 are longer than the central recumbent ties 158. In yet another aspect, the central standing ties 150 are about 300% or triple the length of the central recumbent ties 158. In a further aspect, the ratio of the length of the central standing ties 150 to the length of the central recumbent ties 158 is about 3:1.

Figure 7:
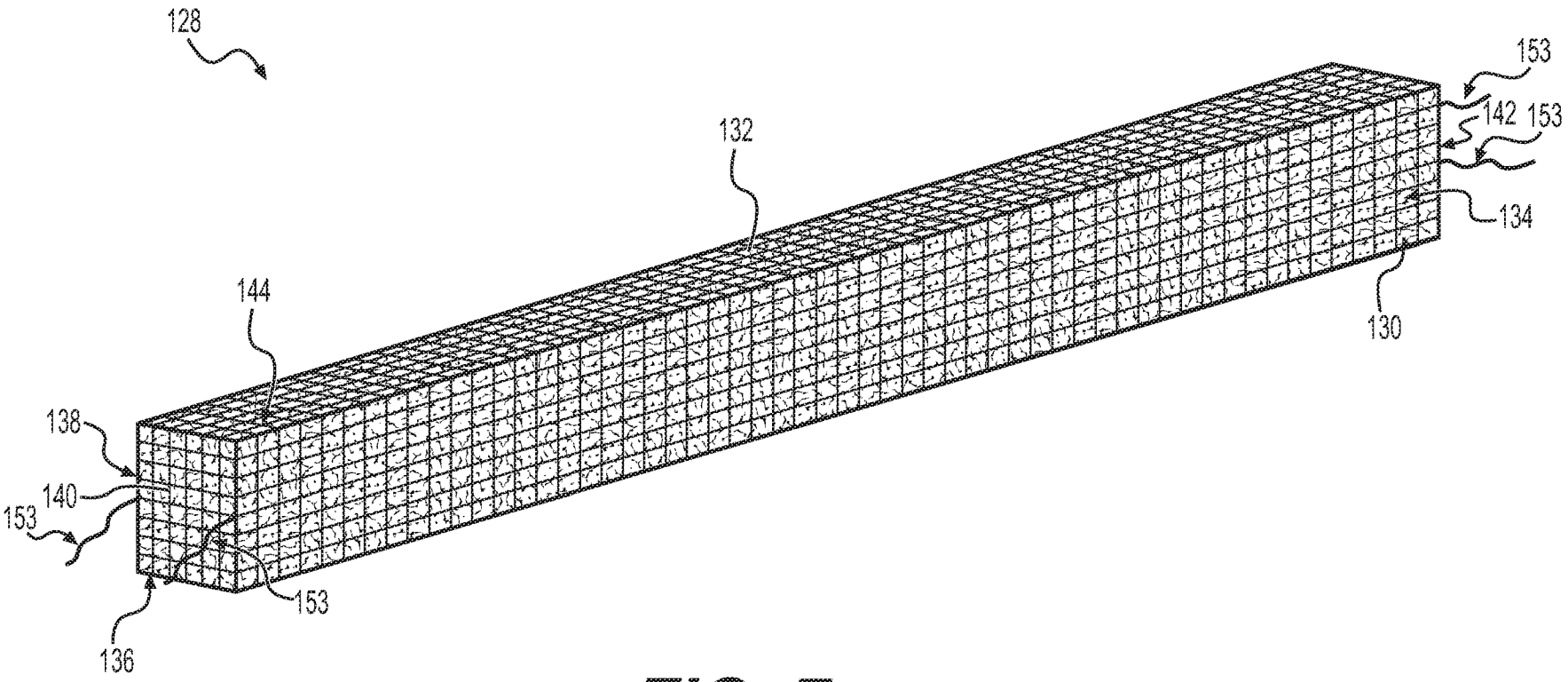
FIG. 7 is a perspective view of the first wing section of the fiber block system shown in FIG. 1 with the central section and the second wing section removed.

As shown in FIG. 7, the first wing section 128 comprises a first wing fiber block 130 formed of compressed coir fibers 115 encased in a first wing sleeve 144 of a high strength first wing mesh 246. The first wing mesh 246 can comprise the same type of fibers as the central mesh 146. In one aspect, both the first wing fiber block 130 and the first wing sleeve 144 consist essentially of coir fibers.

Figure 8:
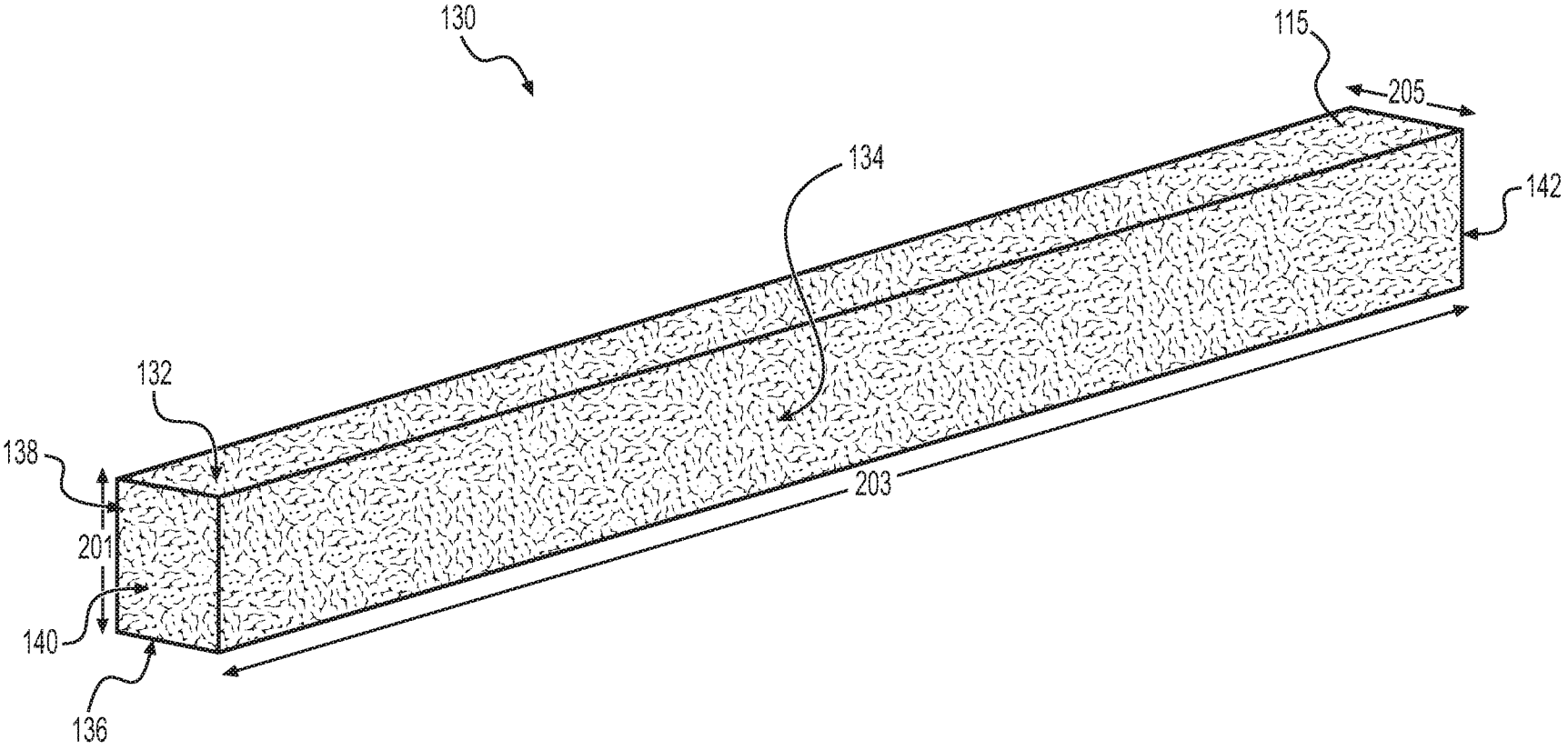
FIG. 8 is perspective view of the first wing fiber block of the first wing section of the fiber block system shown in FIG. 7 with the first wing sleeve removed.

As shown in FIG. 8, the first wing fiber block 130 comprises an elongated portion that is rectangular in cross-section. The first wing fiber block 130 comprises a first wing top side 132, a first wing bottom side 136 opposing the first wing top side 132, a first wing front side 134, a first wing rear side 138 opposing the first wing front side 134, a first wing left side 140, and a first wing right side 142 opposing the first wing left side 140. Each of the first wing top side 132, the first wing front side 134, the first wing bottom side 136, the first wing rear side 138, the first wing left side 140 and the first wing right side 142 are generally flat and rectangular. The first wing right side 142 of the first wing fiber block 130 abuts the central left side 124. The first wing fiber block 130 is completely encased in the first wing sleeve 144. The first wing mesh 246 of the first wing sleeve 144 covers the first wing top side 132, the first wing front side 134, the first wing rear side 138, the first wing bottom side 136, the first wing left side 140, and the first wing right side 142 of the first wing fiber block 130.

A plurality of first wing connecting ties 153 are attached to or near the first wing left side 140 and the first wing right side 142 of the first wing mesh 246 and extend therefrom. The first wing connecting ties 153 are arranged to connect to the central connecting ties 151 located on the central section 110 and/or to the central mesh 146. Two first wing connecting ties 153 are shown attached on each end of the first wing section 128, but the present disclosure encompasses alternative numbers of first wing connecting ties 153 disposed on the first wing section 128.

The first wing fiber block 130 comprises a first wing fiber block height 201 measured from the first wing top side 132 to the first wing bottom side 136, a first wing fiber block length 203 measured from the first wing left side 140 to the first wing right side 142, and a first wing fiber block width 205 measured from first wing front side 134 to the first wing rear side 138. The first wing fiber block height 201 is greater than the first wing fiber block width 205. The first wing fiber block length 203 is greater than both first wing fiber block height 201 and the first wing fiber block width 205. In one aspect, the first wing fiber block height 201 can be about 150% or one and one half times the first wing fiber block width 205. In another aspect, the ratio of the first wing fiber block height 201 to the first wing fiber block width 205 can be about 1.5:1. In yet another aspect, the ratio of the first wing fiber block height 201 to the first wing fiber block width 205 can be greater than about 1.5:1.

Figure 9:
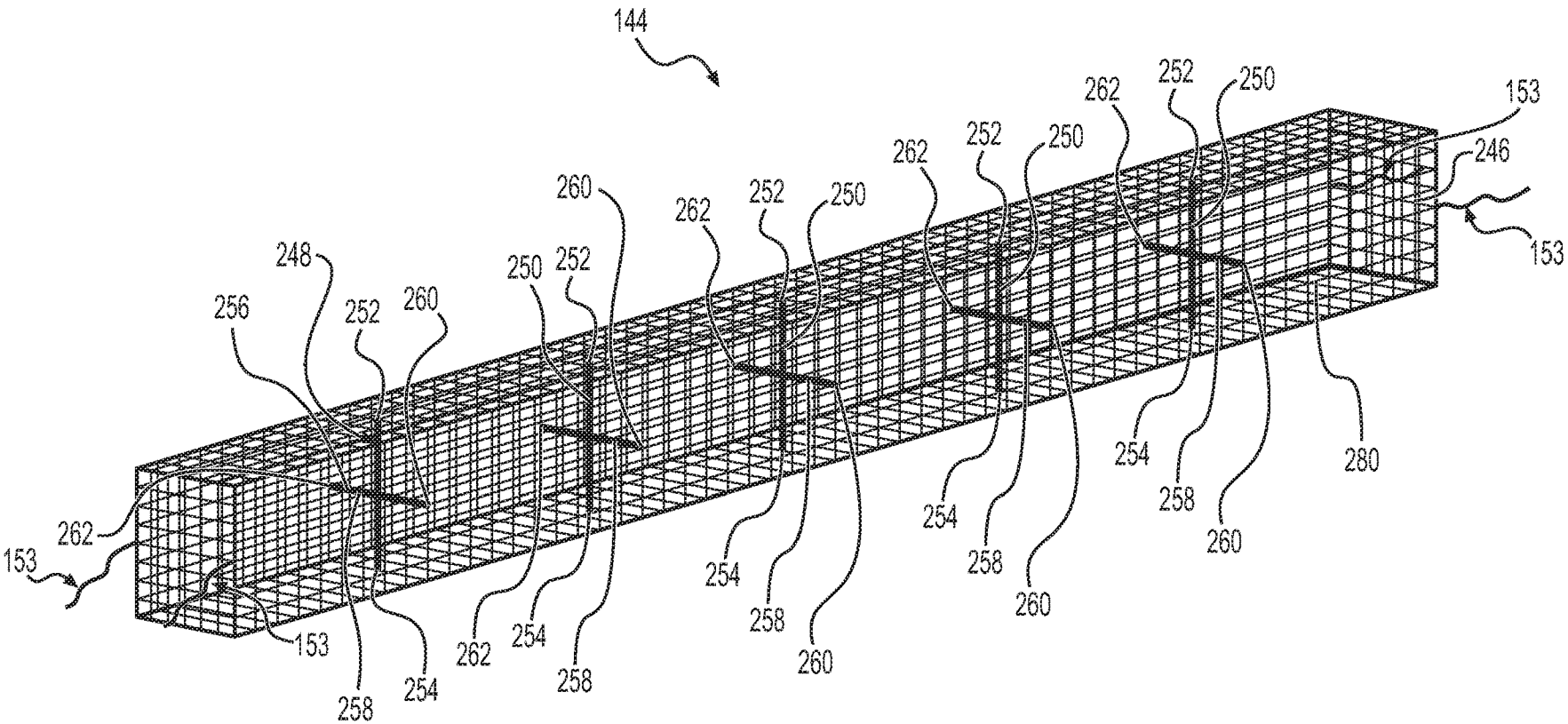
FIG. 9 is a perspective view of the first wing sleeve of the first wing section of the fiber block system shown in FIG. 7 with the first wing fiber block removed.

FIG. 9 illustrates a plurality of first wing ties 248 disposed in the first wing sleeve 144 and attach to the first wing mesh 246 at two different points. Each first wing tie of the plurality of first wing ties 248 extends through the first wing fiber block 130 and outward from two sides of the first wing fiber block 130 connecting to the first wing sleeve 144 at each end thereof.

Each first wing tie of the plurality of first wing ties 248 can be either a first wing standing tie 250 that extends outward from the first wing top side 132 and the first wing bottom side 136 of the first wing fiber block 130 or a first wing recumbent tie 258 that extends outward through the first wing front side 134 and the first wing rear side 138 the first wing fiber block 130. Each first wing standing tie 250 and each first wing recumbent tie 258 of the plurality of first wing ties 248 extends through two opposing sides of the first wing fiber block 130 and is attached to the first wing sleeve 144. Each first wing standing tie 250 comprises a first wing standing first end 252 that extends through the first wing top side 132 of the first wing fiber block 130 and is attached to the first wing sleeve 144 at the first wing top side 132 of the first wing fiber block 130 and a first wing second standing end 254 that extends through the first wing bottom side 136 of the first wing fiber block 130 and is attached to the first wing sleeve 144 at the first wing bottom side 136 of the first wing fiber block 130. Each first wing recumbent tie 258 comprises a first wing recumbent first end 260 that extends through the first wing front side 134 of the first wing fiber block 130 and is attached to the first wing sleeve 144 at the first wing front side 134 of the first wing fiber block 130 and a first wing recumbent second end 262 that extends through the first wing rear side 138 of the first wing fiber block 130 and is attached to the first wing sleeve 144 at the first wing rear side 138 of the first wing fiber block 130. The plurality of first wing ties 248 helps to maintain the rectangular shape and integrity of the first wing section 128 inhibiting the first wing sleeve 134 from bulging outward. The first wing sleeve 144, in turn, tends to keep inward pressure on the sides of the first wing fiber block 130 so as to aid it in maintaining its rectangular shape. A majority of the length of each first wing tie of the plurality of first wing ties 248 is encased in the compressed coir fibers of the first wing fiber block 130 with only the first and second ends of each first wing tie extending outward from the sides of the first wing fiber block 130. Each first wing standing tie 250 can contact and/or be intertwined with a first wing recumbent tie 258 to further aid in maintaining the strength and form of the first wing fiber block 130. Some of the first wing ties of the plurality of first wing ties 248 can be stitched or otherwise connected to the outer sides of the first wing fiber block 130 and also to the first wing sleeve 144 to reinforce the shape and integrity of the first wing section 128. In one aspect, the first wing standing ties 250 can be aligned generally vertically and the first wing recumbent ties 258 can be aligned generally horizontally in the first wing fiber block 130. In another aspect, the first wing standing ties 250 and/or the first wing recumbent ties 258 can be aligned oblique to one or more sides of the first wing fiber block 130. In still another aspect, the first wing standing ties 250 are longer than the first wing recumbent ties 258. In yet another aspect, the first wing standing ties 250 are about 150% or about 1.5 times the length of the first wing recumbent ties 258. In still a further aspect, the first wing standing ties 250 are shorter than the central standing ties 150. In another aspect, the first wing standing ties 250 are about 50% or one half the length of the central standing ties 150. In a further aspect, the first wing recumbent ties 258 are about equal in length to the central recumbent ties 158. In yet another aspect, the first wing recumbent ties 258 are about 100% of the length of the central recumbent ties 158.

Figure 10:
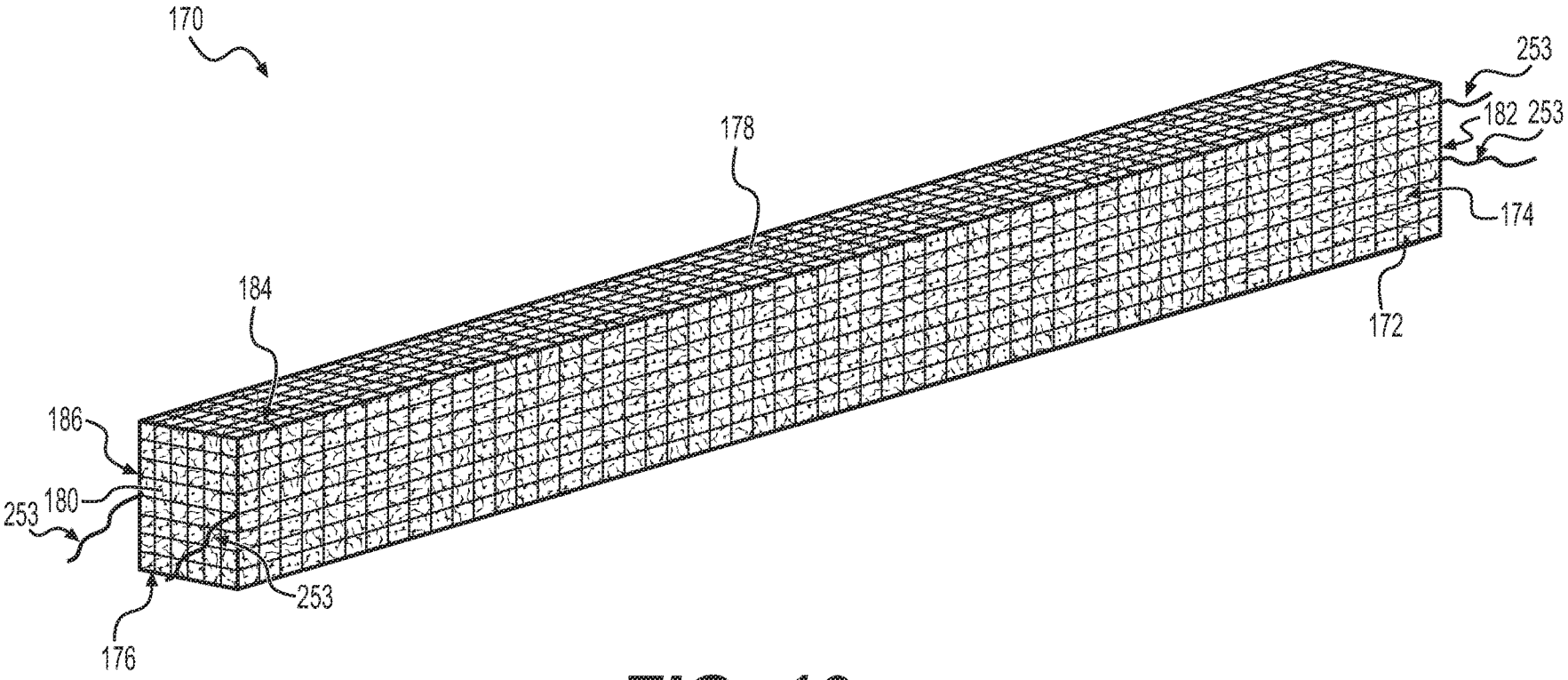
FIG. 10 is a perspective view of the second wing section of the fiber block system shown in FIG. 1 with the central section and the first wing section removed.

As shown in FIG. 10, the second wing section 170 comprises a second wing fiber block 172 formed of compressed coir fibers 115 encased in a second wing sleeve 184 of a high strength second wing mesh 346. The second wing mesh 346 can comprise the same type of fibers as the central mesh 146. In one aspect, both the second wing fiber block 172 and the second wing sleeve 184 consist essentially of coir fibers.

Figure 11:
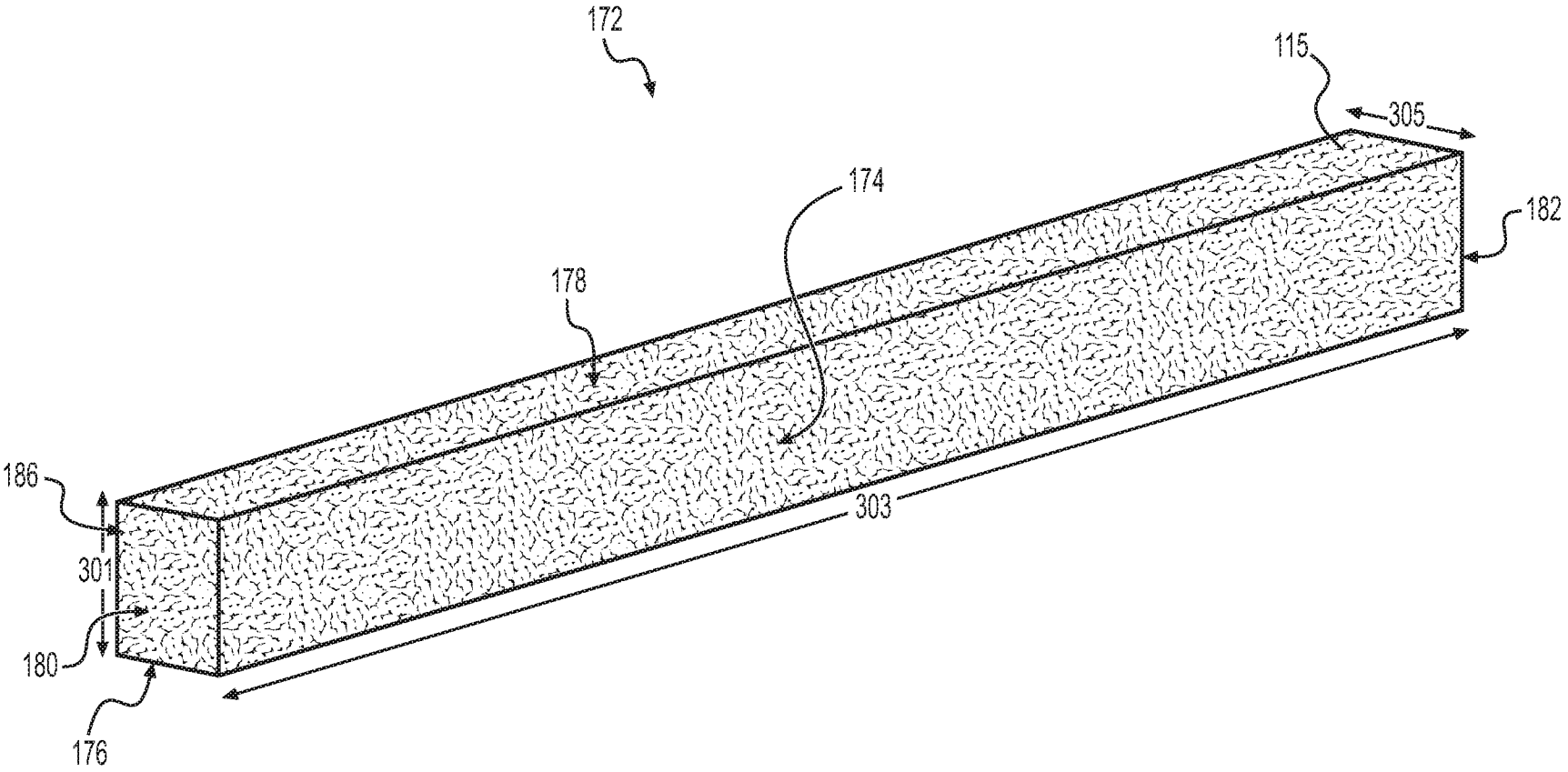
FIG. 11 is perspective view of the second wing fiber block of the second wing section shown in FIG. 10 with the second wing sleeve removed.

The second wing fiber block 172 is elongated and rectangular in cross-section. As shown in FIG. 11, the second wing fiber block 172 comprises a second wing top side 178, a second wing bottom side 176 opposing the second wing top side 178, a second wing front side 174, a second wing rear side 186 opposing the second wing front side 174, a second wing left side 180, and a second wing right side 182 opposing the second wing left side 180. Each of the second wing top side 178, the second wing front side 174, the second wing bottom side 176, the second wing rear side 186, the second wing left side 180 and the second wing right side 182 are generally flat and rectangular. The second wing left side 180 of the second wing fiber block 172 abuts the central right side 126. The second wing fiber block 172 is completely encased in the second wing sleeve 184. The second wing mesh 346 of the second wing sleeve 184 covers the second wing top side 178, the second wing front side 174, the second wing rear side 186, the second wing bottom side 176, the second wing left side 180, and the second wing right side 182 of the second wing fiber block 172. A plurality of second wing connecting ties 253 are attached to or near the second wing left side 180 and the second wing right side 182 of the second wing mesh 346 and extend therefrom. The second wing connecting ties 253 are arranged to connect to central connecting ties 151 located on the central section 128 and/or directly to the central mesh 146.

The second wing fiber block 130 comprises a second wing fiber block height 301 measured from the second wing top side 178 to the second wing bottom side 176, a second wing fiber block length 303 measured from the second wing left side 180 to the second wing right side 182, and a second wing fiber block width 305 measured from second wing front side 174 to the second wing rear side 186. The second wing fiber block height 301 is greater than the second wing fiber block width 305. The second wing fiber block length 303 is greater than both second wing fiber block height 301 and the second wing fiber block width 305. In one aspect, the second wing fiber block height 301 can be about 150% or about one and one half times the second wing fiber block width 305. In another aspect, the first wing fiber block height 201 is about equal to the second wing fiber block height 301. In yet another aspect, the first wing fiber block height 201 and the second wing fiber block height 301 are about 50% or about one half of the central fiber block height 101. In a further aspect, the ratio of the central fiber block height 101 to the first wing fiber block height 201 and the second wing fiber block height 301 is about 2:1. In still another aspect, the first wing fiber block width 205 and the second fiber block width 305 are equal to the central fiber block width 105. In still a further aspect, the ratio of the central fiber block width 10 to both the first wing fiber block width 205 and the second fiber block width 305 are equal to the central fiber block width 105 is about 2:1.

The fiber block system 100 can be constructed in different versions that exhibit differing heights. In one aspect, the fiber block system 100 can comprise a central section 110 that has a central fiber block height 101 of about 23 cm and a central fiber block width of 105 of about 7.5 cm; a first wing section 128 that has a first wing fiber block height 201 of about 11.5 cm and a first wing fiber block width 205 of about 7.5 cm; and, a second wing section 170 that has a second wing fiber block height 301 of about 11.5 cm and a second wing fiber block width of about 7.5 cm. In another aspect, the fiber block system 100 can comprise a central section 110 that has a central fiber block height 101 of about 30 cm and a central fiber block width of 105 of about 10 cm; a first wing section 128 that has a first wing fiber block height 201 of about 15 cm and a first wing fiber block width 205 of about 10 cm; and, a second wing section 170 that has a second wing fiber block height 301 of about 15 cm and a second wing fiber block width of about 10 cm. In a further aspect, the fiber block system 100 can comprise a central section 110 that has a central fiber block height 101 of about 45 cm and a central fiber block width of 105 of about 13 cm; a first wing section 128 that has a first wing fiber block height 201 of about 22.5 cm and a first wing fiber block width 205 of about 13 cm; and, a second wing section 170 that has a second wing fiber block height 301 of about 22.5 cm and a 15 second wing fiber block width of about 13 cm. Fiber block systems comprising central and wing sections with alternative heights and widths are encompassed by the present disclosure.

A plurality of second wing connecting ties 253 are attached to or near the second wing left side 180 and the second wing right side 242 of the second wing mesh 346 and extend therefrom. The second wing connecting ties 253 are arranged to connect to the central connecting ties 151 located on the central section 110 and/or to the central mesh 146, thereby connecting the second wing section 170 to the central section 110. Two second wing connecting ties 253 are shown attached on each end of the second wing section 170, but the present disclosure encompasses alternative numbers of second wing connecting ties 253 disposed on the second wing section 170.

Figure 12:
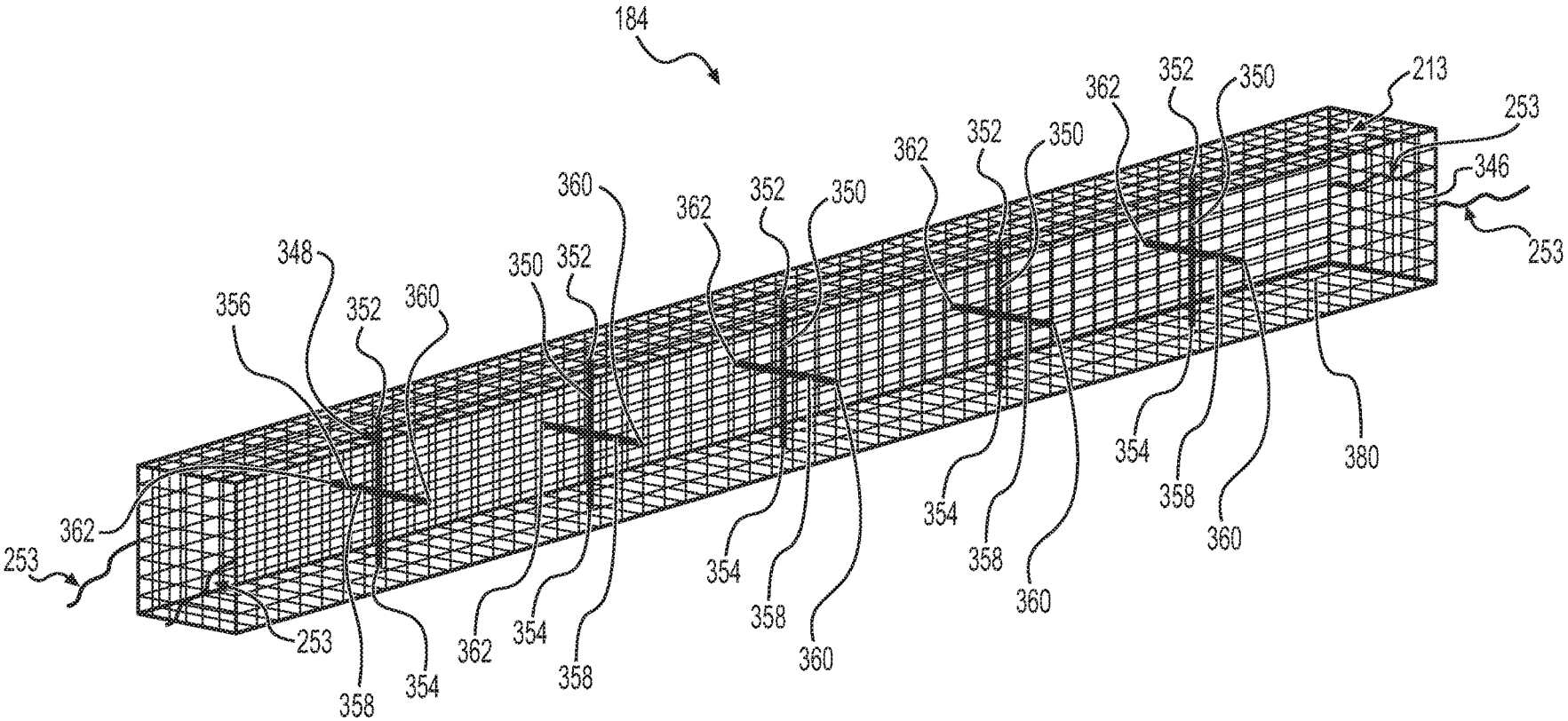
FIG. 12 is a perspective view of the second wing sleeve of the second wing section shown in FIG. 10 with the second wing fiber block removed.

FIG. 12 illustrates a plurality of second wing ties 348 disposed in the second wing sleeve 184 and attach to the second wing mesh 346 at two different points. Each second wing tie of the plurality of second wing ties 348 extends through the second wing fiber block 172 and outward from two sides of the second wing fiber block 172 connecting to the second wing sleeve 184 at each end thereof.

Each second wing tie of the plurality of second wing ties 348 can be either a second wing standing tie 350 that extends outward from the second wing top side 178 and the second wing bottom side 176 of the second wing fiber block 172 or a second wing recumbent tie 358 that extends outward through the second wing front side 174 and the second wing rear side 186 of the second wing fiber block 172. Each second wing standing tie 350 and each second wing recumbent tie 358 of the plurality of second wing ties 348 extends through two opposing sides of the second wing fiber block 172 and is attached to the second wing sleeve 184. Each second wing standing tie 350 comprises a second wing standing first end 352 that extends through the second wing top side 178 of the second wing fiber block 172 and is attached to the second wing sleeve 184 at the second wing top side 178 of the second wing fiber block 172 and a second wing second standing end 354 that extends through the second wing bottom side 176 of the second wing fiber block 172 and is attached to the second wing sleeve 184 at the second wing bottom side 176 of the second wing fiber block 172. Each second wing recumbent tie 358 comprises a second wing recumbent first end 360 that extends through the second wing front side 174 of the second wing fiber block 172 and is attached to the second wing sleeve 184 at the second wing front side 174 of the second wing fiber block 172 and a second wing recumbent second end 362 that extends through the second wing rear side 186 of the second wing fiber block 172 and is attached to the second wing sleeve 184 at the second wing rear side 186 of the second wing fiber block 172. The plurality of second wing ties 348 helps to maintain the rectangular shape and integrity of the second wing section 170 inhibiting the second wing sleeve 184 from bulging outward. The second wing sleeve 184, in turn, tends to keep inward pressure on the sides of the second wing fiber block 172 so as to aid it in maintaining its rectangular shape. A majority of the length of each second wing tie of the plurality of second wing ties 348 is encased in the compressed coir fibers of the second wing fiber block 172 with only the first and second ends of each second wing tie extending outward from the sides of the second wing fiber block 172. Each second wing standing tie 350 can contact and/or be intertwined with a second wing recumbent tie 358 to further aid in maintaining the strength and form of the second wing fiber block 172. Some of the second wing ties of the plurality of second wing ties 348 can be stitched or otherwise connected to the outer sides of the second wing fiber block 172 and also to the second wing sleeve 184 to reinforce the shape and integrity of the second wing section 170. In one aspect, the second wing standing ties 350 can be aligned generally vertically and the second wing recumbent ties 358 can be aligned generally horizontally in the second wing fiber block 172. In another aspect, the second wing standing ties 350 and/or the second wing recumbent ties 358 can be aligned oblique to one or more sides of the second wing fiber block 172. In still another aspect, the second wing standing ties 350 are longer than the second wing recumbent ties 358. In yet another aspect, the second wing standing ties 350 are about 150% or 1.5 times the length of the second wing recumbent ties 358. In still a further aspect, the second wing standing ties 350 are shorter than the central standing ties 150. In another aspect, the central wing standing ties 350 are about 50% or one half the length of the central standing ties 150. In a further aspect, the second wing recumbent ties 358 are about equal in length to the central recumbent ties 158 and the first wing recumbent ties 258. In yet another aspect, the second wing recumbent ties 358 are about 100% of the length of the central recumbent ties 158 and the first wing recumbent ties 258.

Figure 13:
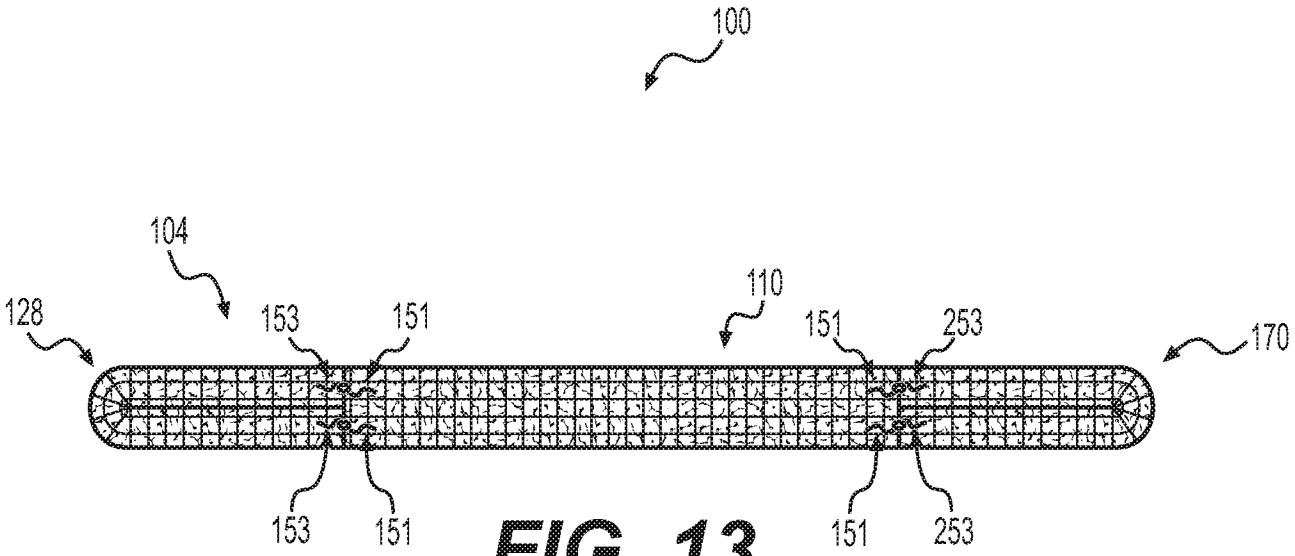
FIG. 13 is a side elevation view of the fiber block system shown in FIG. 1 arranged in a folded configuration with the first and second wing sections folded.

FIG. 13 illustrates the fiber block system 100 in an alternative arrangement with the first wing section 128 and the second wing section 170 folded to form a folded configuration 104. In the folded configuration 104, the overall length of the fiber block system 100 is shortened by the folding upward and inward of each of the first wing section 128 and the second wing section 170 so that each of the first and second wing sections 128 and 170 are folded approximately in half and the first wing left side 140 of the first wing section 128 and the second wing right side 182 of the second wing section 170 are aligned proximal to the central section 110. The first wing left side 140 and the second wing right side 182 can by connected proximal to the central section 110 by connecting the first wing and second wing connecting ties 153 and 253, located on the first wing section 128 and the second wing section 170, respectively, to the central connecting ties 151 on the central section 110 and/or to central mesh 146. The connection of the first wing and second wing connecting ties 153 and 253 to portions of the central section 110 allows for the first wing sleeve 144 and the second wing sleeve 184 to be connected to the central sleeve 114. The first wing section 128 and the second wing section 170 are folded upward and inward such that the distal half of the first wing top side 132 is folded down on and contacts the proximal half of the first wing top side 132. Likewise, the distal half of the second wing top side 178 is folded down on and contacts the proximal half of the second wing top side 178. In the folded configuration 104, each of the first wing section 128 and the second wing section 170 is doubled upon itself, thereby doubling the total height of the respective first wing and second wing sections 128 and 170. In one aspect, the first wing fiber block height 201 and the second wing fiber block height 301 are each about 50% or one half the central fiber block height 101 in the extended configuration 102, and the total heights of each of the first wing section 128 and the second wing section 170 are each about 100% or about equal to the central fiber block height 101 in the folded configuration 104. In another aspect, the ratio of the central fiber block height 101 to the first wing block height 201 is about 2:1 in the extended configuration 102. In a further aspect, the ratio of the central fiber block height 101 to the second wing block height 301 is about 2:1 in the extended configuration 102. In yet another aspect, the ratio of the central fiber block height 101 to the overall total height of the folded first wing section 128 is about 1:1 in the folded configuration 104. In still a further aspect, the ratio of the central fiber block height 101 to the overall total height of the folded second wing section 170 is about 1:1 in the folded configuration 104.

Figure 14:
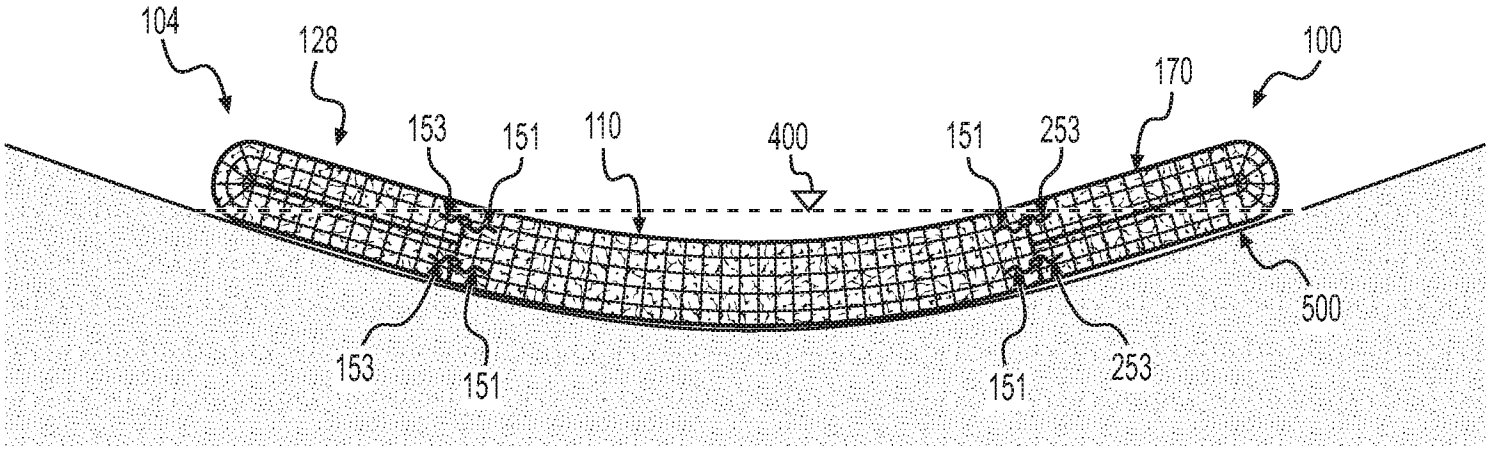
FIG. 14 is a side elevation view system of the fiber block system shown in FIG. 13 in the folded configuration and installed across a water drainage pathway with water shown by a water line.

FIG. 14 illustrates the fiber block system 100 in the folded configuration 104 and installed in a ditch 500 and aligned perpendicular to a water flow 400 extending through the ditch 500. The central front side 118 of the central fiber block 112, the first wing front side 134 of the first wing fiber block 130, and the second wing front side 174 of the second wing fiber block 172 are installed facing towards the water flow 400. When water flow 400 flows towards the fiber block system 100, the water in the water flow 400 generally flows over the fiber block system 100 and silt carried by the water flow 400 tends to contact and settle in front of the fiber block system 100, thereby preventing silt to pass beyond the fiber block system 100.

Figure 15:
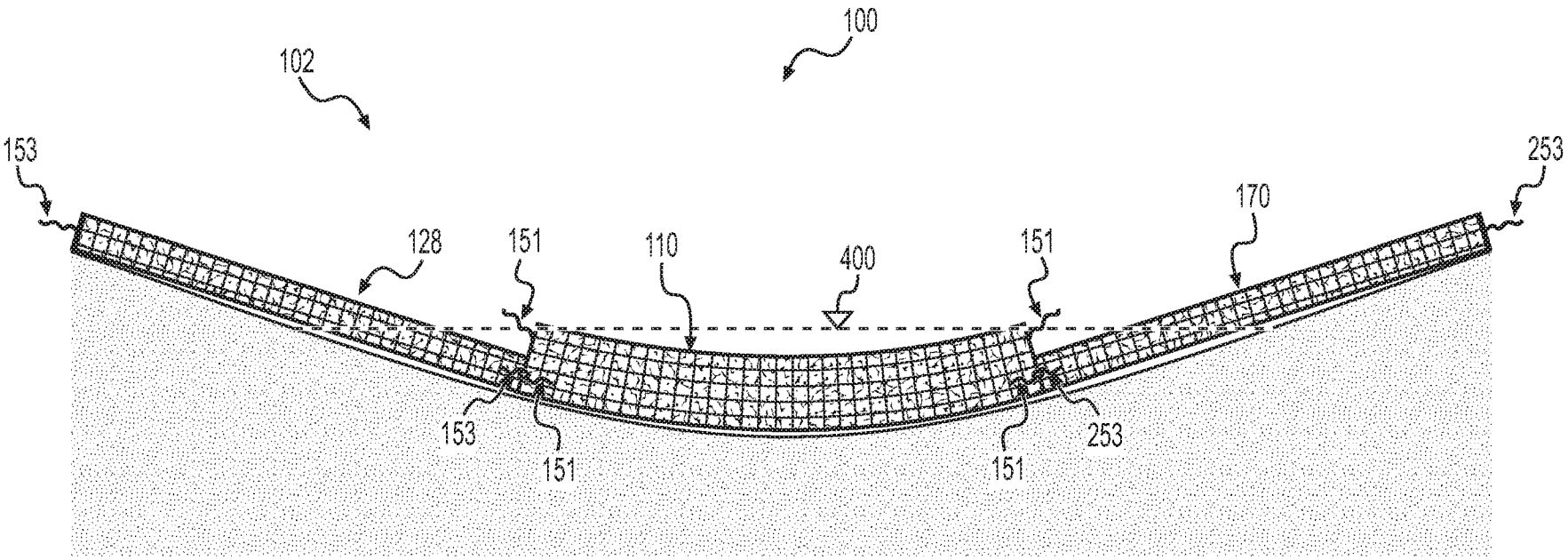
FIG. 15 is a side elevation view system of the fiber block system shown in FIG. 14 installed across a water drainage pathway with water shown by a water line and with the fiber block system in the extended configuration with the first and second wing sections unfolded and extended.

FIG. 15 illustrates the fiber block system 100 in the extended configuration 102 and installed in the ditch 500. The first wing and second wing connecting ties 153 and 253 disposed on the outer ends of the first and second wing sections 128 and 170 are disengaged from the central section 110 and the first and second wing sections 128 and 170 are unfolded and extended. The first wing and second wing sections 128 and 170 remain connected to the central section 110 by the first wing and second wing connecting ties 153 and 253 located on first wing right side 142 and the second wing left side 180 being connected to the central section 110. The first and second wing sections 128 and 170 extend beyond the outer boundaries of the water flow 400, thereby forcing the water flow 400 to flow over and not around the fiber block system 100. Sediment contained in the water flow 400 can settle in front of the fiber block system 100.

When the water flow 400 flows over the fiber block system 100, as shown in FIG. 15, one portion of the water flow 400 flows over the central section 110, a second portion of the water flow 400 flows over the first wing section 128, and a third portion of the water flow 400 flows over the second wing section 170. Since the central fiber block height 101 is greater than both the first wing height 201 and the second wing height 301, the force of the water overflowing the fiber block system 100 when the water strikes the ditch surface is greater at the central section 110 than at the first wing section 128 and the second wing section 170. The reduced force of the water overflowing the tops of the first wing section 128 and the second wing section 170 can tend to reduce the scouring effect of the water as compared to the scouring effect exhibited by water overflowing a conventional check dam that is the same height all along the length thereof.

Figure 16:
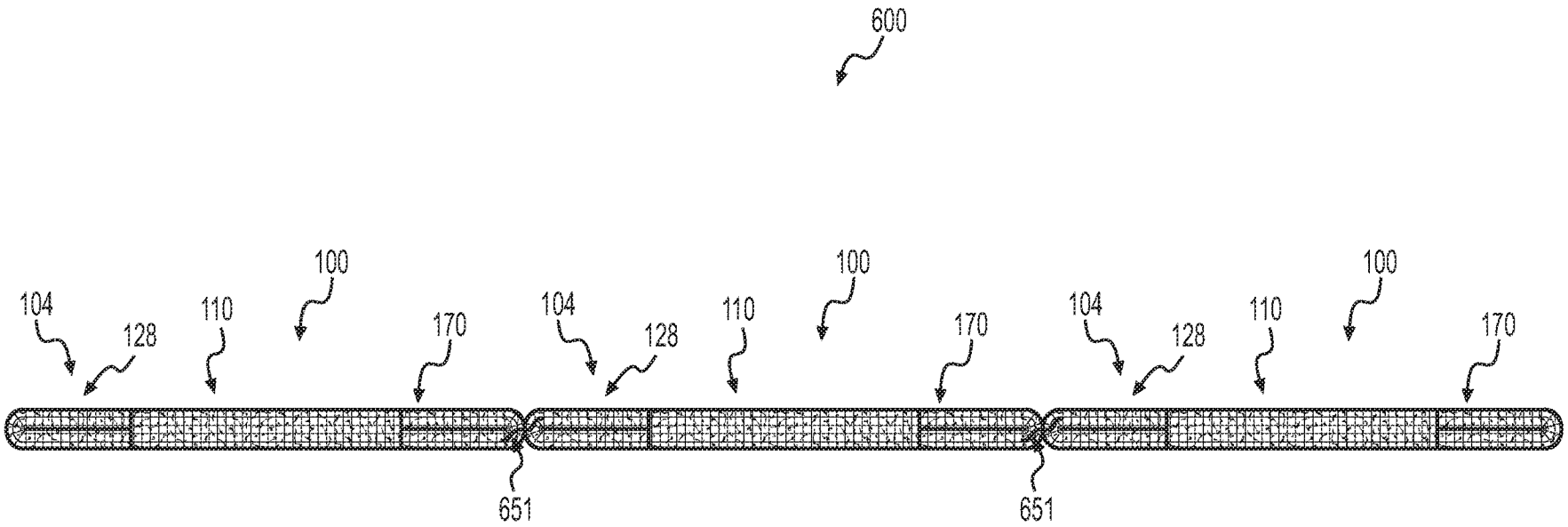
FIG. 16 is a side elevation view of a fiber block system chain formed of a plurality of fiber block systems in folded configurations connected together.

The fiber block system 100 illustrated in FIGS. 15 and 16 can optionally be secured within the ditch 500 by securing the central section 110 with one or more stakes and/or staples (not shown) inserted into the ground adjacent to the central front side 118 and/or the central rear side 124 of the central fiber block 112, as well as the front and rear sides of the first and second wing sections 128 and 170. One or more anchoring ties (not shown) can be secured to two or more of the stakes on opposing sides of the central section 110 and pulled across the central top side 116 to secure the fiber block system 100 to the ground within the ditch 500.

FIG. 16 illustrates a plurality of fiber block systems 100 connected to form a fiber block system chain 600. Each of the fiber block systems 100 are arranged in a folded configuration 104 with the first and second wing sections 128 and 170 folded and connected at both ends to the central section 100. Each fiber block system 100 is connected to the other fiber block systems 100 in the fiber block system chain 600 by one or more connecting ties 651. The binding ties 651 are attached to the first and second wing sections 128 and 170 of adjoining fiber block systems 100 to connect the systems into the fiber block system chain 600. The fiber block systems 100 are connected end-to-end in the fiber block system chain 600 with the ends of the fiber block systems 100 being aligned along the mid-points of the first and second wing sections 128 and 170, which are folded in the folded configurations 104.

Figure 17:
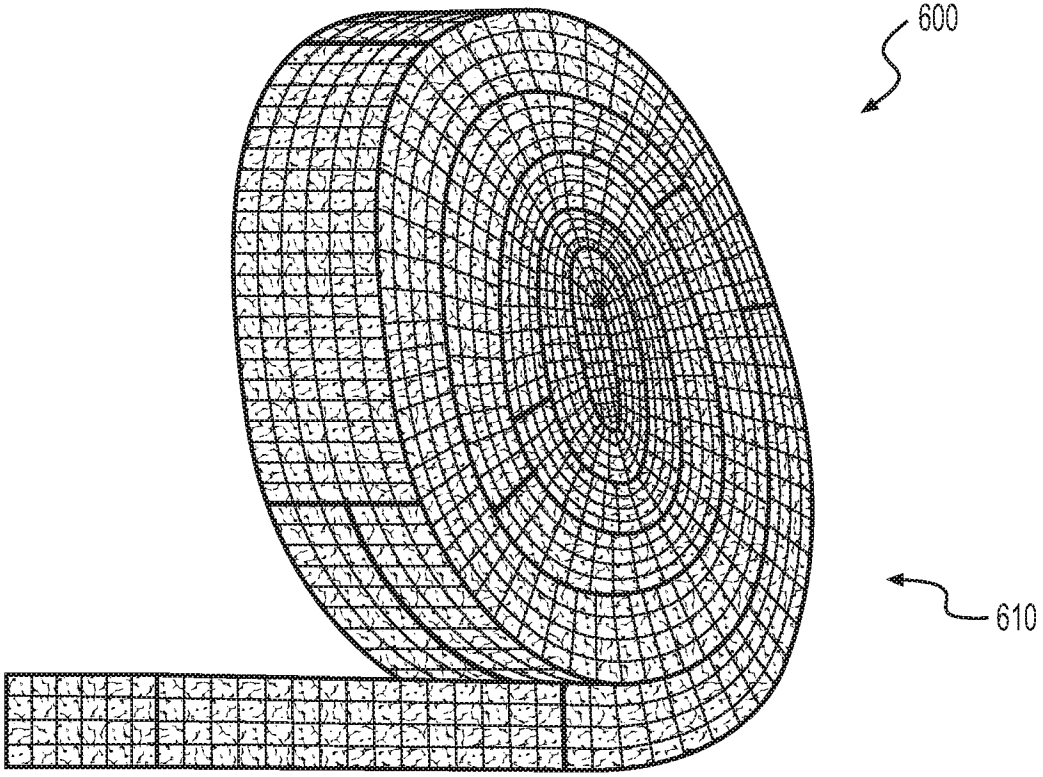
FIG. 17 is a perspective view of the fiber block system chain shown in FIG. 17 rolled into a fiber block system chain coil.
Figure 18:
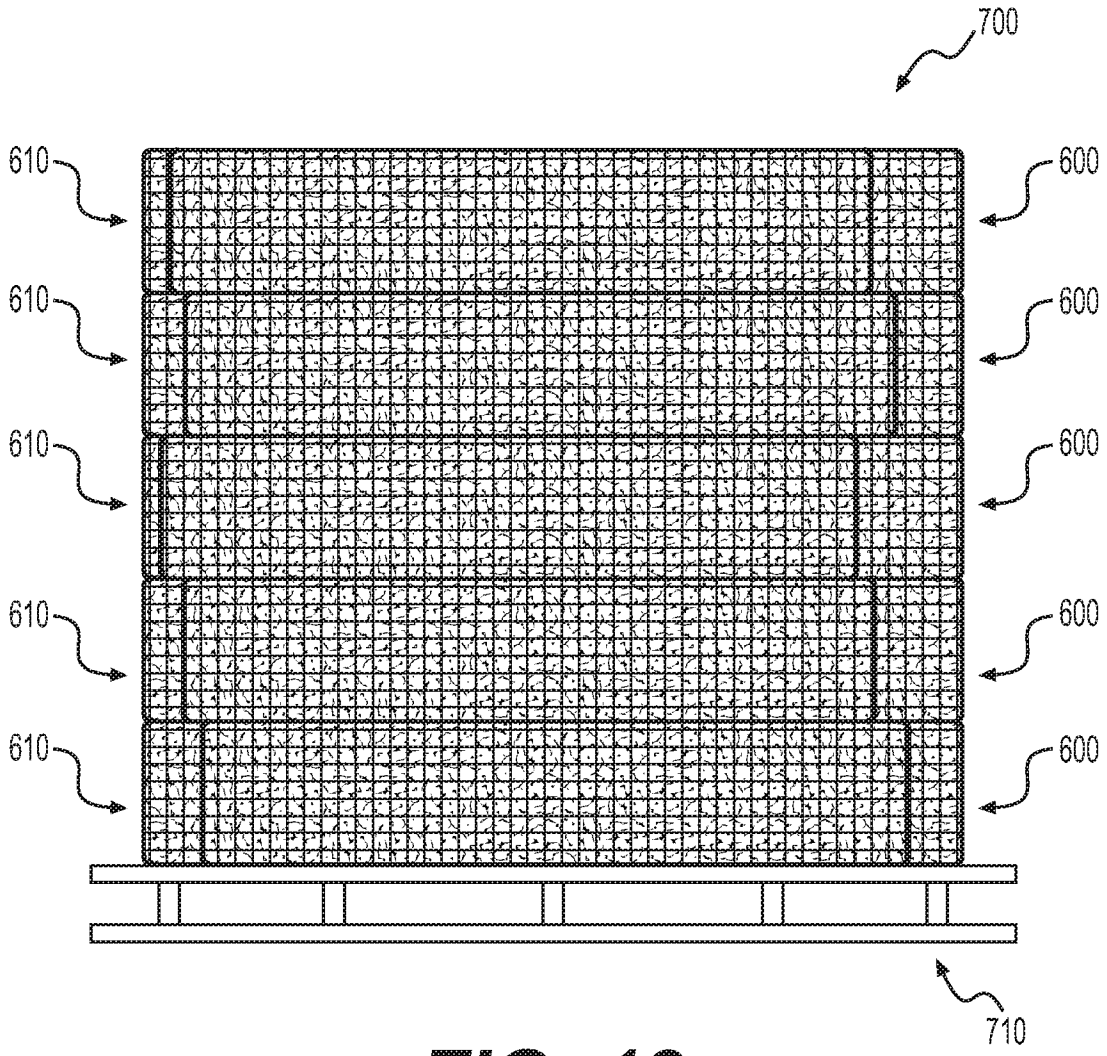
FIG. 18 is a perspective view of a plurality of fiber block system chain coils stacked into a fiber block chain coil stack disposed on a pallet.

FIG. 17 illustrates a fiber block system chain 600 rolled into a coil. The fiber block system chain 600 can be stored and/or transported more efficiently by rolling the fiber block system chain 600 into a fiber block system chain coil 610. FIG. 18 illustrates a fiber block system chain stack 700 formed of a plurality of fiber block system chain coils 610 stacked one upon another. The fiber block systems chain coils 610 can be stacked on a pallet 710 to form a fiber block system chain coil stack 700, whereby the fiber block systems 100 can be stored and/or transported.

The fiber block system 100 can be constructed by feeding loose coir fibers into forms that are shaped like the central fiber block 112, the first wing fiber block 130, and the second wing fiber block 172 and then compressed to cause the coir fibers to bind together and maintain the shape of the respective form thereby forming the respective central, first wing, and second wing fiber blocks 112, 130, and 172. For the central section 110, an open end of the central sleeve 114 can receive the central fiber block 112 therein, thereby allowing the central sleeve 114 to slide over the central fiber block 112. The central sleeve 114 can then be tighten around the central fiber block 112, followed by stitching at the central fiber block left and right sides 124 and 126 to completely encase the central fiber block 112. Central standing ties 150 and central recumbent ties 158 can be threaded through the central fiber block 112 so that each tie 150 and 158 projects outward from two opposing sides of central fiber block 112 and then the opposing ends of each tie can be connected to the central sleeve 114 on opposing sides of the central fiber block 112. The first wing section 128 and the second wing section 170 can be constructed using similar steps.

Once each of the central section 110, the first wing section 128 and the second wing section 170 are individually constructed, they are joined together. The first wing section 128 is connected to the central section 110 by first aligning the first wing section 128 endways with the central section 100, such that the first wing right side 142 is aligned adjacent to and abutting the central left side 124 of the central section 110, and then tying the first wing connecting ties 153 mounted the first wing mesh 246 proximal to the first wing right side 142 on the first wing section 128 to the central connecting ties 151 mounted on the central mesh 146 proximal to the central left side 124 of the central section 110 and/or directly to the adjacent the central mesh 146. One or more of the central connecting ties 151 mounted on the central mesh 146 proximal to the central left side 124 of the central section 110 also can be tied directly to the first wing mesh 246. The second wing section 170 is connected to the central section 110 by first aligning the second wing section 170 endways with the central section 100, such that the second wing left side 180 is aligned adjacent to and abutting the central right side 126 of the central section 110, and then tying the second wing connecting ties 253 mounted the second wing mesh 346 proximal to the second wing left side 180 on the second wing section 170 to the central connecting ties 151 mounted on the central mesh 146 proximal to the central right side 126 of the central section 110 and/or directly to the adjacent the central mesh 146. One or more of the central connecting ties 151 mounted on the central mesh 146 proximal to the central right side 126 of the central section 110 also can be tied directly to the second wing mesh 346.

The fiber block system 100 can be installed as illustrated and used in check dam formation applications. The fiber block system 100 can be installed and aligned so as to form a barrier to existing or potential water flows that may contain sediment or other solids. The fiber block systems 100 can act to remove or reduce the amount of sediment and other solids within the water flows so as to reduce the extent of possible erosion or introduction of the solids into a body of water.

Other embodiments of the present disclosure will be apparent to those skilled in the art from their consideration of the specification and practice of the present disclosure disclosed in this document. The applicant intends that the specification and examples be considered as exemplary only, with the true scope and spirit of the present disclosure being indicated by the following claims.

The invention claimed is:

1. A fiber block system for check dam applications comprising:

a central section comprising a central fiber block and a central sleeve encasing the central fiber block, wherein the central fiber block comprises a central top side, a central bottom side opposing the central top side, a central front side connected to the central top side, a central rear side opposing the central front side and extending between the central top side and the central bottom side, a central right side, and a central left side opposing the central right side, wherein the central fiber block exhibits a central fiber block height measured from the central bottom side to the central top side, wherein the central sleeve comprises natural fibers, and wherein the central fiber block comprises compressed natural fibers;

a first wing section connected to the central section, wherein the first wing section comprises a first wing fiber block and a first wing sleeve encasing the first wing fiber block, wherein the first wing fiber block comprises a first wing top side, a first wing bottom side opposing the first wing top side, a first wing front side connected to the first wing top side, a first wing rear side opposing the first wing front side and extending between the first wing top side and the first wing bottom side, a first wing right side, and a first wing left side opposing the first wing right side, wherein the first wing right side abuts the central left side of the central fiber block, wherein the first wing fiber block exhibits a first wing fiber block height measured from the first wing top side to the first wing bottom side, wherein the central fiber block height is greater than the first wing fiber block height, wherein the first wing sleeve comprises natural fibers, and wherein the first wing fiber block comprises compressed natural fibers; and, a second wing section connected to the central section, wherein the second wing section comprises a second wing fiber block and a second wing sleeve encasing the second wing fiber block, wherein the second wing fiber block comprises a second wing top side, a second wing bottom side opposing the second wing top side, a second wing front side connected to the second wing top side, a second wing rear side opposing the second wing front side and extending between the second wing top side and the second wing bottom side, a second wing right side, and a second wing left side opposing the second wing right side, wherein the second wing left side abuts the central right side of the central fiber block, wherein the second wing section exhibits a second wing fiber block height measured from the second wing top side to the second wing bottom side, wherein the central fiber block height is greater than the second wing fiber block height, wherein the second wing sleeve comprises natural fibers, and wherein the second wing fiber block comprises compressed natural fibers.

2. The fiber block system of claim 1, further comprising a plurality of central ties extending through the central fiber block, wherein each central tie of the plurality of central ties comprises a central first end extending through one of the central top side, the central bottom side, the central front side, and the central rear side of the central fiber block and a central second end extending through another of the central top side, the central bottom side, the central front side, and the central rear side of the central fiber block, wherein each central tie of the plurality of central ties connects to the central sleeve at the central first end and the central second end of the central tie, whereby the plurality of central ties supports the central fiber block, and wherein each central tie of the plurality of central ties comprises natural fibers.

3. The fiber block system of claim 1, further comprising a plurality of first wing ties extending through the first wing fiber block, wherein each first wing tie of the plurality of first wing ties comprises a first wing end extending through one of the first wing top side, the first wing bottom side, the first wing front side, and the first wing rear side of the first wing fiber block and a second wing end extending through another of the first wing top side, the first wing bottom side, the first wing front side, and the first wing rear side of the first wing fiber block, wherein each first wing tie of the plurality of first wing ties connects to the first wing sleeve at the first wing end and at the second wing end of the first wing tie, whereby the plurality of first wing ties supports the first wing fiber block, and wherein each first wing tie of the plurality of first wing ties comprises natural fibers.

4. The fiber block system of claim 1, further comprising a plurality of second wing ties extending through the second wing fiber block, wherein each second wing tie of the plurality of second wing ties comprises a first wing end extending through one of the second wing top side, the second wing bottom side, the second wing front side, and the second wing rear side of the second wing fiber block and a second wing end extending through another of the second wing top side, the second wing bottom side, the second wing front side, and the second wing rear side of the second wing fiber block, wherein each second wing tie of the plurality of second wing ties connects to the second wing sleeve at the first wing end and the second wing end of the second wing tie, whereby the plurality of second wing ties supports the second wing fiber block, and wherein each second wing tie of the plurality of second wing ties comprises natural fibers.

5. The fiber block system of claim 1, wherein the central fiber block exhibits a central fiber block width measured from the central front side to the central rear side, and wherein the central fiber block height is greater than the central fiber block width.

6. The fiber block system of claim 1, wherein the ratio of the central fiber block height to the central fiber block width is about 3:1.

7. The fiber block system of claim 5, wherein the first wing fiber block exhibits a first wing fiber block width measured from the first wing front side to the first wing rear side, and wherein the first wing fiber block height is greater than the first wing fiber block width.

8. The fiber block system of claim 7, wherein the ratio of the first wing fiber block height to the first wing fiber block width is about 1.5:1.

9. The fiber block system of claim 7, wherein the second wing fiber block exhibits a second wing fiber block width measured from the second wing front side to the second wing rear side, and wherein the second wing fiber block height is greater than the second wing fiber block width.

10. The fiber block system of claim 1, wherein the fiber block system is reconfigurable between a folded configuration and an extended configuration, wherein the first wing section is folded with the first wing left side aligned proximal to the central left side of the central fiber block and the second wing section is folded with the second wing right side aligned proximal to the central right side in the folded configuration, and wherein the first wing section is unfolded and extended with the first wing left side aligned distal to the central left side of the central fiber block and the second wing section is unfolded and extended with the second wing right side aligned distal to the central right side in the extended configuration.

11. The fiber block system of claim 10, wherein the first wing left side is connected to the central left side and the second wing right side is connected to the central right side in the folded configuration.

12. A fiber block system chain comprising a plurality of fiber block systems of claim 1, wherein each fiber block system of the plurality of fiber block systems is connected to another fiber block system of the plurality of fiber block systems.

13. The fiber block system chain of claim 12, wherein each fiber block system of the plurality of fiber block systems is in a folded configuration, wherein the first wing section of each fiber block system of the fiber block system chain is folded with the first wing left side aligned proximal to the central left side of the central fiber block of the fiber block system and the second wing section of each fiber block system of the fiber block system chain is folded with the second wing right side aligned proximal to the central right side of the central fiber block of the fiber block system.

14. The fiber block system of claim 1, wherein the natural fibers comprises coir fibers.

15. A fiber block system for check dam applications comprising:

a central section comprising a central fiber block and a central sleeve encasing the central fiber block, wherein the central fiber block is rectangular, wherein the central fiber block comprises a central fiber block length, a central fiber block height, and a central fiber block width, wherein the central fiber block length is greater than the central fiber block width, wherein the central fiber block height is greater than the central block width, wherein the central sleeve comprises natural fibers, and wherein the central fiber block comprises natural fibers;

a first wing section connected to the central section, wherein the first wing section comprises a first wing fiber block and a first wing sleeve encasing the first wing fiber block, wherein the first wing fiber block is rectangular, wherein the first wing fiber block comprises a first wing fiber block length, a first wing fiber block height, and a first wing fiber block width, wherein the first wing fiber block length is greater than the first wing block width, wherein the first wing fiber block height is greater than the first wing fiber block width, wherein the central fiber block height is greater than the first wing fiber block height, wherein the first wing section abuts the central section, wherein the first wing section is aligned endways with the central section, wherein the first wing sleeve comprises natural fibers, and wherein the first wing fiber block comprises compressed natural fibers; and, a second wing section connected to the central section, wherein the section wing section comprises a second wing fiber block and a second wing sleeve encasing the second wing fiber block, wherein the second wing fiber block is rectangular, wherein the second wing fiber block comprises a second wing fiber block length, a second wing fiber block height, and a second wing fiber block width, wherein the second wing fiber block length is greater than the second wing fiber block width, wherein the second wing fiber block height is greater than the second wing fiber block width, wherein the central fiber block height is greater than the second wing fiber block height, wherein the second wing section abuts the central section, wherein the second wing section is aligned endways with the central section, wherein the second wing sleeve comprises natural fibers, and wherein the second wing fiber block comprises compressed natural fibers.

16. The fiber block system of claim 15, wherein the fiber block system is reconfigurable between a folded configuration and an extended configuration, wherein the first wing section and the second wing section are folded inward towards the central section in the folded configuration, and wherein the first wing section and the second wing section are unfolded and extended in the extended configuration.

17. The fiber block system of claim 15, wherein the ratio of the central fiber block height to the central fiber block width is about 3:1.

18. The fiber block system of claim 15, wherein the first wing fiber block height is equal to the second wing fiber block height.

19. A fiber block system for check dam applications comprising:

a central section comprising a central fiber block and a central sleeve encasing the central fiber block, wherein the central fiber block comprises a central top side, a central bottom side opposing the central top side, a central front side connected to the central top side, a central rear side opposing the central front side and extending between the central top side and the central bottom side, a central right side, and a central left side opposing the central right side, wherein the central fiber block exhibits a central fiber block height measured from the central bottom side to the central top side, wherein the central fiber block exhibits a central fiber block width measured from the central front side to the central rear side, wherein the ratio of the fiber block height to the central fiber block width is about 3:1, wherein the central sleeve comprises natural fibers, and wherein the central fiber block comprises compressed natural fibers;

a first wing section connected to the central section, wherein the first wing section comprises a first wing fiber block and a first wing sleeve encasing the first wing fiber block, wherein the first wing fiber block comprises a first wing top side, a first wing bottom side opposing the first wing top side, a first wing front side connected to the first wing top side, a first wing rear side opposing the first wing front side and extending between the first wing top side and the first wing bottom side, a first wing right side, and a first wing left side opposing the first wing right side, wherein the first wing right side abuts the central left side of the central fiber block, wherein the first wing fiber block exhibits a first wing fiber block height as measured from the first wing top side to the first wing bottom side, wherein the ratio of the central fiber block height to the first wing fiber block height is about 2:1, wherein the first wing sleeve comprises natural fibers, and wherein the first wing fiber block comprises compressed natural fibers; and, a second wing section connected to the central section, wherein the second wing section comprises a second wing fiber block and a second wing sleeve encasing the second wing fiber block, wherein the second wing fiber block comprises a second wing top side, a second wing bottom side opposing the second wing top side, a second wing front side connected to the second wing top side, a second wing rear side opposing the second wing front side and extending between the second wing top side and the second wing bottom side, a second wing right side, and a second wing left side opposing the second wing right side, wherein the second wing left side abuts the central right side of the central fiber block, wherein the second wing section exhibits a second wing fiber block height measured from the second wing top side to the second wing bottom side, wherein the ratio of the central fiber block height to the second wing fiber block height is about 2:1, wherein the second wing sleeve comprises natural fibers, wherein the second wing fiber block comprises compressed natural fibers.

* * * * *